US006629522B2

(12) United States Patent
Andrews

(10) Patent No.: US 6,629,522 B2
(45) Date of Patent: Oct. 7, 2003

(54) COMPOUND BOW HAVING A LIMITED FREEDOM OF MOVEMENT BETWEEN COJOURNALED CAMS

(75) Inventor: Albert A. Andrews, Cleveland, TN (US)

(73) Assignee: Spenco, Inc., Dunlap, TN (US)

( * ) Notice: Subject to any disclaimer, the term of this patent is extended or adjusted under 35 U.S.C. 154(b) by 52 days.

(21) Appl. No.: 09/851,629

(22) Filed: May 9, 2001

(65) Prior Publication Data

US 2002/0166550 A1 Nov. 14, 2002

(51) Int. Cl.[7] ..... F41B 5/10
(52) U.S. Cl. ..... 124/25.6; 124/900
(58) Field of Search ..... 124/25.6, 900

(56) References Cited

U.S. PATENT DOCUMENTS

| | | | | |
|---|---|---|---|---|
| 3,486,495 | A | 12/1969 | Allen | 124/24 |
| 3,987,777 | A | 10/1976 | Darlington | 124/23 |
| 4,079,723 | A | 3/1978 | Darlington | 124/24 |
| 4,368,718 | A | 1/1983 | Simonds et al. | 124/23 |
| 4,519,374 | A | 5/1985 | Miller | 124/23 |
| 4,739,744 | A | 4/1988 | Nurney | 124/23 |
| 4,967,721 | A | 11/1990 | Larson | 124/25.6 |
| 5,040,520 | A | 8/1991 | Nurney | 124/25.6 |
| 5,368,006 | A | 11/1994 | McPherson | 124/25.6 |
| 5,535,727 | A | 7/1996 | Helmuth | 124/25.6 |
| 5,649,522 | A | 7/1997 | Troncoso | 124/25.6 |
| 5,782,229 | A | 7/1998 | Evans et al. | 124/25.6 |
| 5,791,322 | A | 8/1998 | McPherson | 124/25.6 |
| 5,809,982 | A | 9/1998 | McPherson | 124/25.6 |
| 5,890,480 | A | 4/1999 | McPherson | 124/25.6 |
| 5,960,778 | A | 10/1999 | Larson | 124/25.6 |
| 5,975,067 | A | 11/1999 | Strother | 124/25.6 |
| 6,035,840 | A | 3/2000 | McPherson | 124/25.6 |
| 6,035,841 | A | 3/2000 | Martin et al. | 124/25.6 |
| 6,082,346 | A | 7/2000 | Andrews et al. | 124/25.6 |
| 6,082,347 | A | 7/2000 | Darlington | 124/25.6 |
| 6,098,607 | A | 8/2000 | Strother | 124/25.6 |
| 6,250,293 | B1 * | 6/2001 | Andrews | 124/25.6 |
| 6,415,780 | B1 * | 7/2002 | Proctor | 124/25.6 |

* cited by examiner

*Primary Examiner*—John A. Ricci
(74) *Attorney, Agent, or Firm*—Law Office of Timothy E. Siegel; Timothy E. Siegel

(57) ABSTRACT

A compound archery bow comprising a body having first and second flexible ends. A bowstring has at least a portion of itself trained about a rotational assembly and is anchored to a cam assembly. In addition, an anchor cable has a first cable end fixed to the first end of the bow and a second cable end secured to the cam assembly. The cam assembly has a bowstring anchor projection and an anchor cable anchor projection for anchoring the bowstring and the anchor cable, respectively and an anchor cable track for taking in the anchor cable as the bow is being drawn. The cam assembly also has a bowstring track for letting out bowstring cable as the bow is being drawn and a mechanical linkage permitting limited relative motion between the bowstring cable track and the anchor cable track.

18 Claims, 39 Drawing Sheets

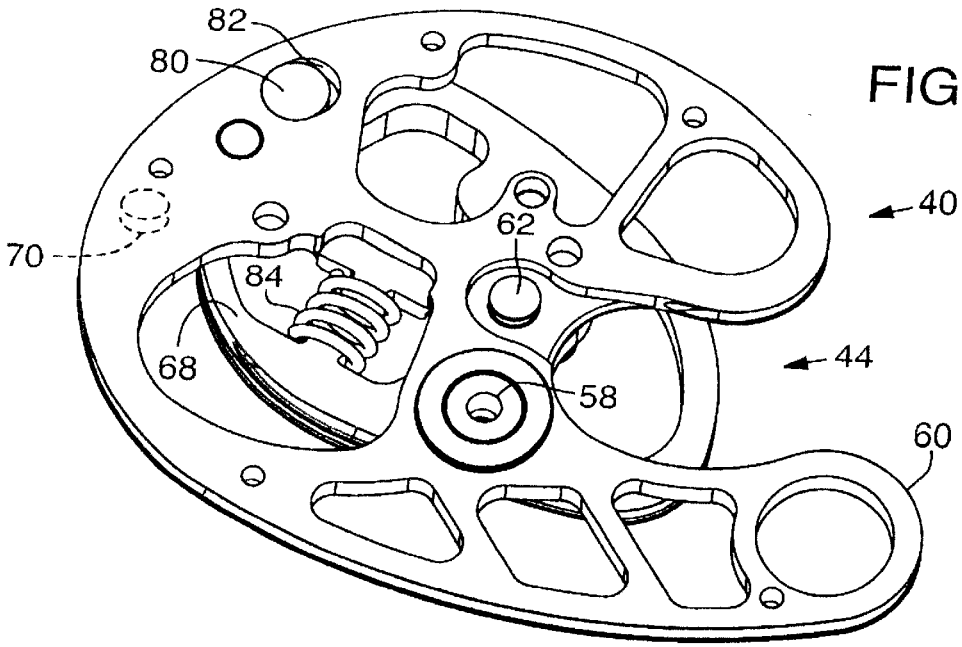
FIG. 4
FIG. 5
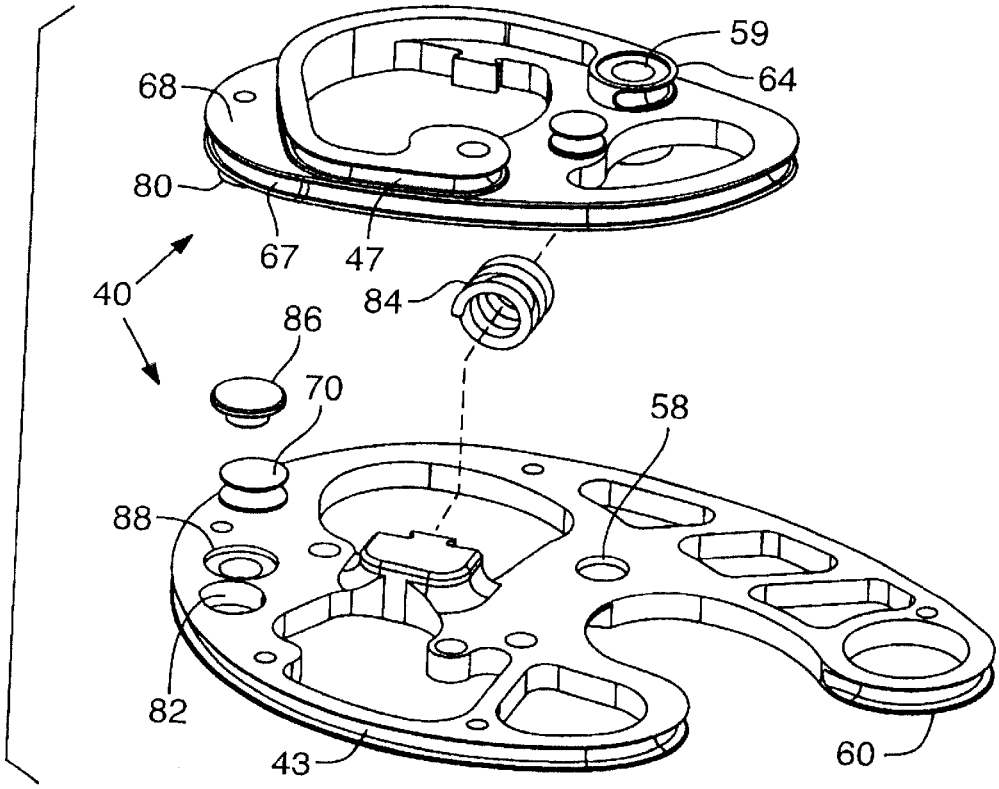

COMPOUND BOW HAVING A LIMITED FREEDOM OF MOVEMENT BETWEEN COJOURNALED CAMS

BACKGROUND

In a traditional archery bow, an archer must pull back with increasing force as he pulls the bowstring further back. Consequently, a great deal of strength may be needed to shoot an arrow with the full force of such a bow. This problem has been addressed with the advent of the compound bow, which employs at least one cam to create a draw force characteristic that actually decreases as the bowstring is pulled back past a certain point. The first compound bow had a cam at both the top and bottom of the bow to evenly leverage the draw force against the bow limbs. Unfortunately, with this arrangement it was difficult to keep the movement of the two cams synchronized as the bowstring was pulled back over repeated uses. To correct for this problem, a bow has been devised in which a single cam having a number of eccentric tracks is mounted at one end of the bow. Both ends of the bowstring cable are anchored to this cam and a grooved wheel is provided at the other end of the bow, around which the bowstring cable is looped. In this manner, there is no way for the bowstring cable feed out to be desynchronized as both ends of the cable are fed out by tracks that are rigidly fixed in place relative to one another on the single cam.

Unfortunately when an arrow is shot a compound bow, whether of the one cam or two-cam variety, loses a portion of the energy stored in the bow limbs to kinetic energy of the rotational members, which are accelerated rapidly to a swift rotation. This kinetic energy, in turn, causes the bow to ring at the end of the arrow shoot.

SUMMARY

In a first separate aspect the present invention is a compound archery bow comprising a body having first and second flexible ends. A rotational assembly and a cam assembly are rotatably mounted on the body and spaced apart from each other. A bowstring has at least a portion of itself trained about the rotational assembly and is anchored to the cam assembly. In addition, an anchor cable has a first cable end fixed to the first end of the bow and a second cable end secured to the cam assembly. The cam assembly has a bowstring anchor projection and an anchor cable anchor projection for anchoring the bowstring and the anchor cable, respectively and an anchor cable track for taking in the anchor cable as the bow is being drawn. The cam assembly also has a bowstring track for letting out bowstring cable as the bow is being drawn and a mechanical linkage permitting limited relative motion between the bowstring cable track and the anchor cable track.

In a second separate aspect, the present invention is an archery bow cam assembly, including tracks for receiving cables, which may be placed into a first state wherein the tracks are in a first arrangement relative to one another or a second state wherein the tracks are in a second arrangement relative to one another. Mechanical energy is stored as the cam assembly is placed in the second state from the first state and is released as the cam assembly changes into the first state from the second state.

The foregoing and other objectives, features and advantages of the invention will be more readily understood upon consideration of the following detailed description of the invention, taken in conjunction with the accompanying drawings.

BRIEF DESCRIPTION OF THE DRAWINGS

FIG. 4 is a perspective view of the cam assembly of FIG. 2, rotated 180° from the view of FIG. 2.

FIG. 5 is an exploded view of the cam assembly of FIG. 2.

DETAILED DESCRIPTION OF THE PREFERRED EMBODIMENTS

Figure 1A:
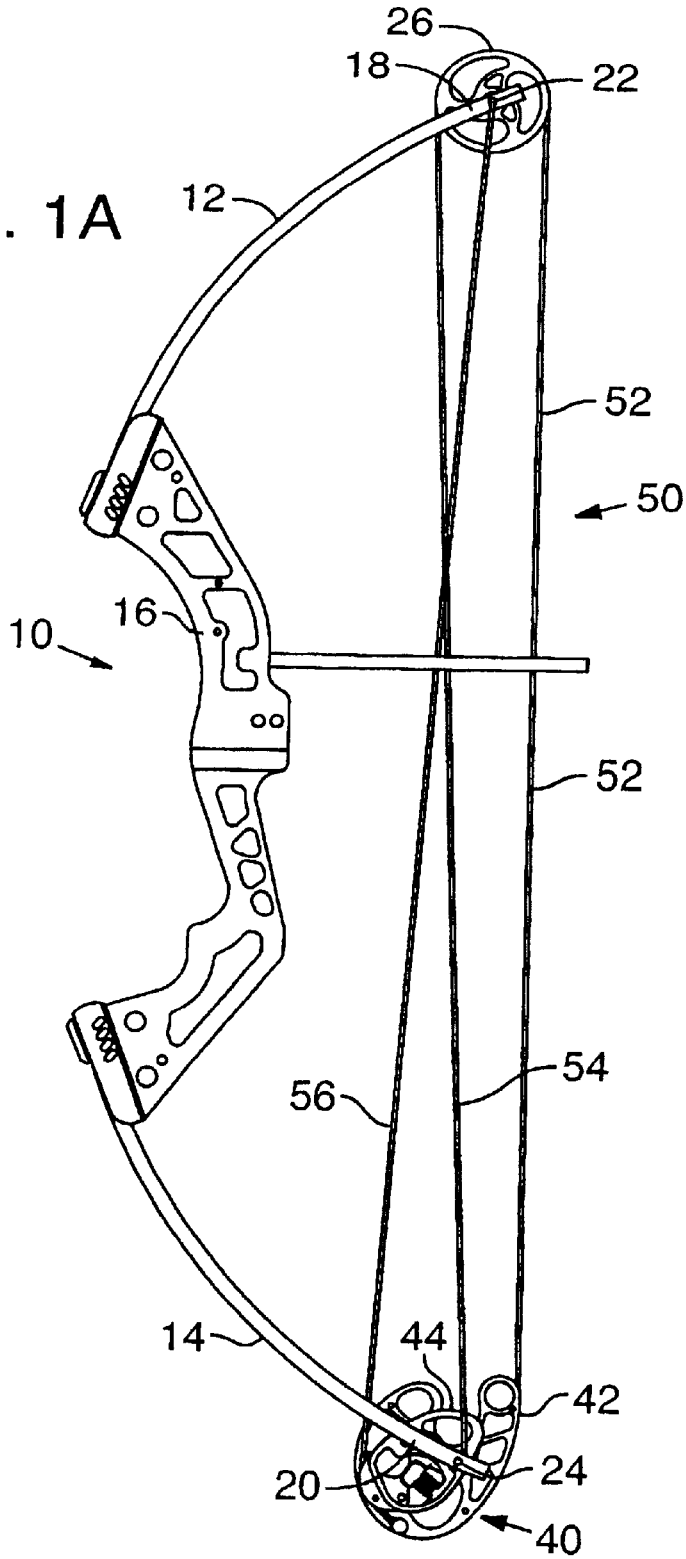
FIG. 1A is a side view of an archery bow, in rest position, according to the present invention.
Figure 1B:
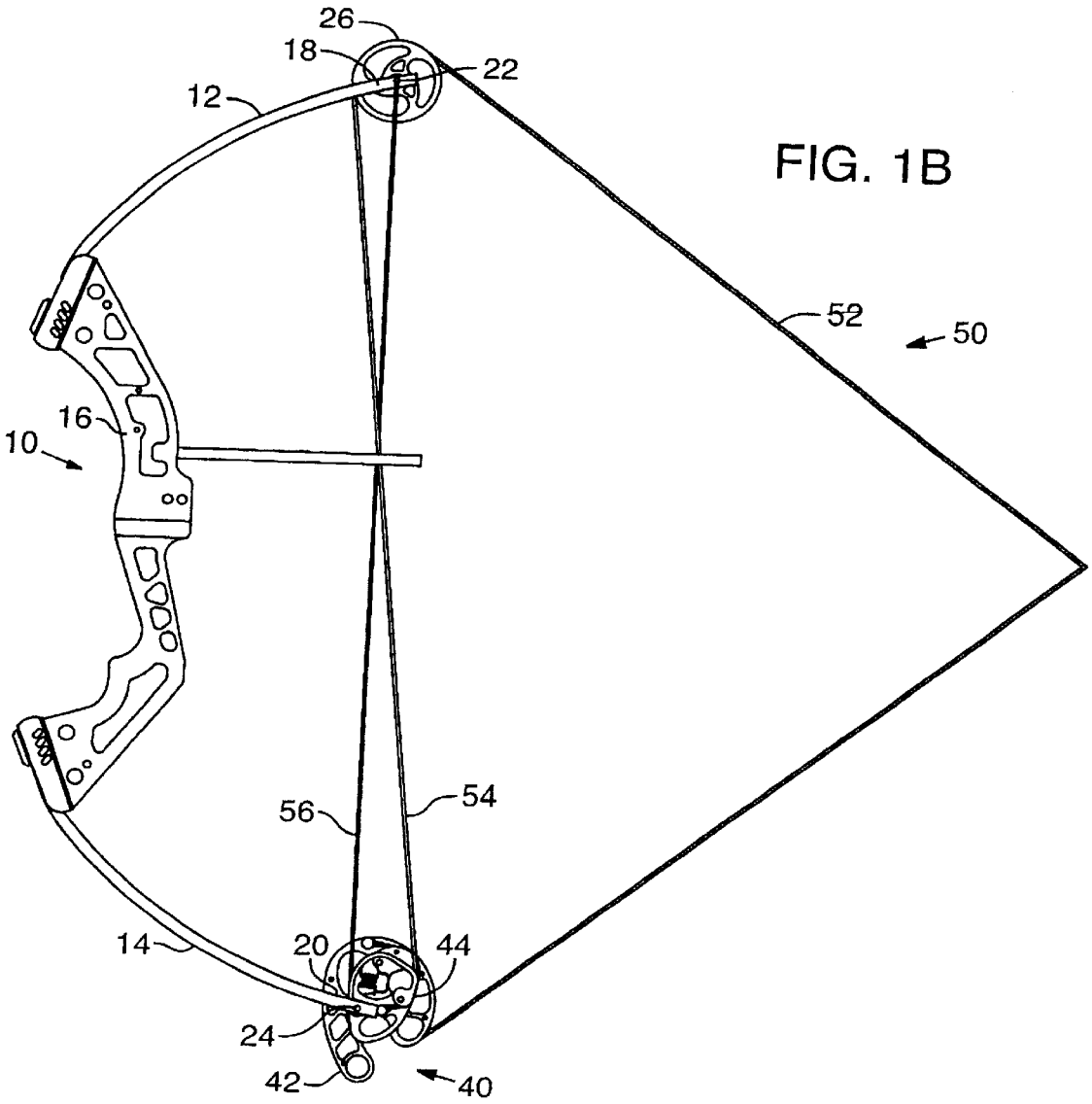
FIG. 1B is a side view of an archery bow, in drawn position, according to the present invention.
Figure 2:
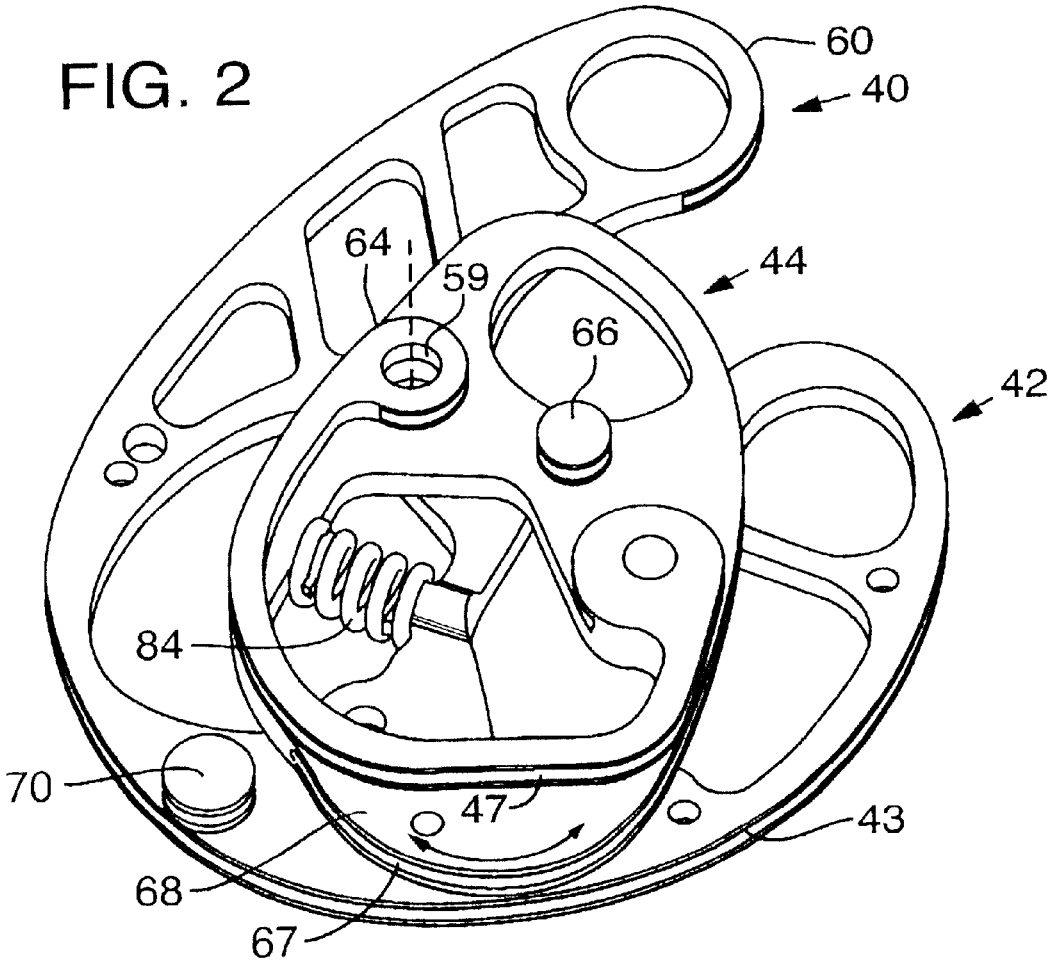
FIG. 2 is a perspective view of a cam assembly similar to that of the archery bow of FIG. 1, except for that it is in mirror image form laterally.

In gross form as shown in FIGS. 1A and 1B, an archery bow 10 according to a first preferred embodiment of the present invention is similar to some prior art archery bows. A top resilient limb 12 and a bottom resilient limb 14 are operatively joined together by way of a handle or riser 16. The resilient limbs 12 and 14 are split at their distal ends into a top mounting fork 18 and a bottom mounting fork 20 respectively, supporting a top axle 22 and a bottom axle 24 respectively. A pulley 26, having a single rim track, is rotatably mounted on top axle 22. A cam assembly 40 having a primary cam 42 and a secondary cam 44 (FIGS. 2–7, in lateral mirror image form, for a right-handed bow as opposed to the left-handed bow of FIG. 1), both of is eccentrically mounted on bottom axle 24.

A bowstring cable 50 is anchored to the primary cam 42, looped about the pulley 26 and then also anchored to the secondary cam 44. The section of bowstring cable 50 from the primary cam 42 to the pulley 26 is designated as a bowstring 52 and the section from the pulley 26 to the secondary cam 44 is designated as a return cable section 54. In addition, an anchor cable 56 is anchored by a split yolk to the two ends of top axle 22 and is anchored at bottom to the secondary cam 44. As an archer draws the bowstring 52, the primary cam 42 and the secondary cam 44 both let out bowstring cable 50. In turn, however, anchor cable 56 is taken up by primary cam 42 and helps to pull limbs 12 and 14 towards each other.

Referring now to FIGS. 2–7, for a more detailed description of a preferred embodiment of a cam assembly 40, cams 42 and 44 are mounted to bottom axle by way of mounting holes 58 and 59 respectively. Bowstring 52 meets cam 42 at a bowstring receiving projection 60 and is threaded onto a bowstring track 43. The bowstring track 43 wraps around primary cam 42 and the bowstring 52 is finally anchored at a bowstring pin or projection 62. Return cable section 54 is taken up by the secondary cam 44 at a return projection 64, winds about the secondary cam 44 on a return section track 47 and is anchored at a return section pin or projection 66. Finally, anchor cable 56 is threaded through an anchor cable track 67 defined by a module structure 68 of secondary cam 44 and is anchored at an anchor cable pin 70.

A limited amount of movement is permitted between primary cam 42 and secondary cam 44 by means of a limiter pin 80 (FIG. 4), which projects outwardly from secondary cam 44 and fits into a limiter slot 82 of primary cam 42. A mechanical energy storage device 84, such as a spring, is compressed as the bowstring is pulled; thereby storing energy that is released after the bowstring is released. This avoids some of the friction losses encountered in other compound bows in the far portion of the draw. Consequently, there is a more consistent push to the arrow, after the bowstring is released and a resultant increase in for the arrow velocity.

Figure 3A:
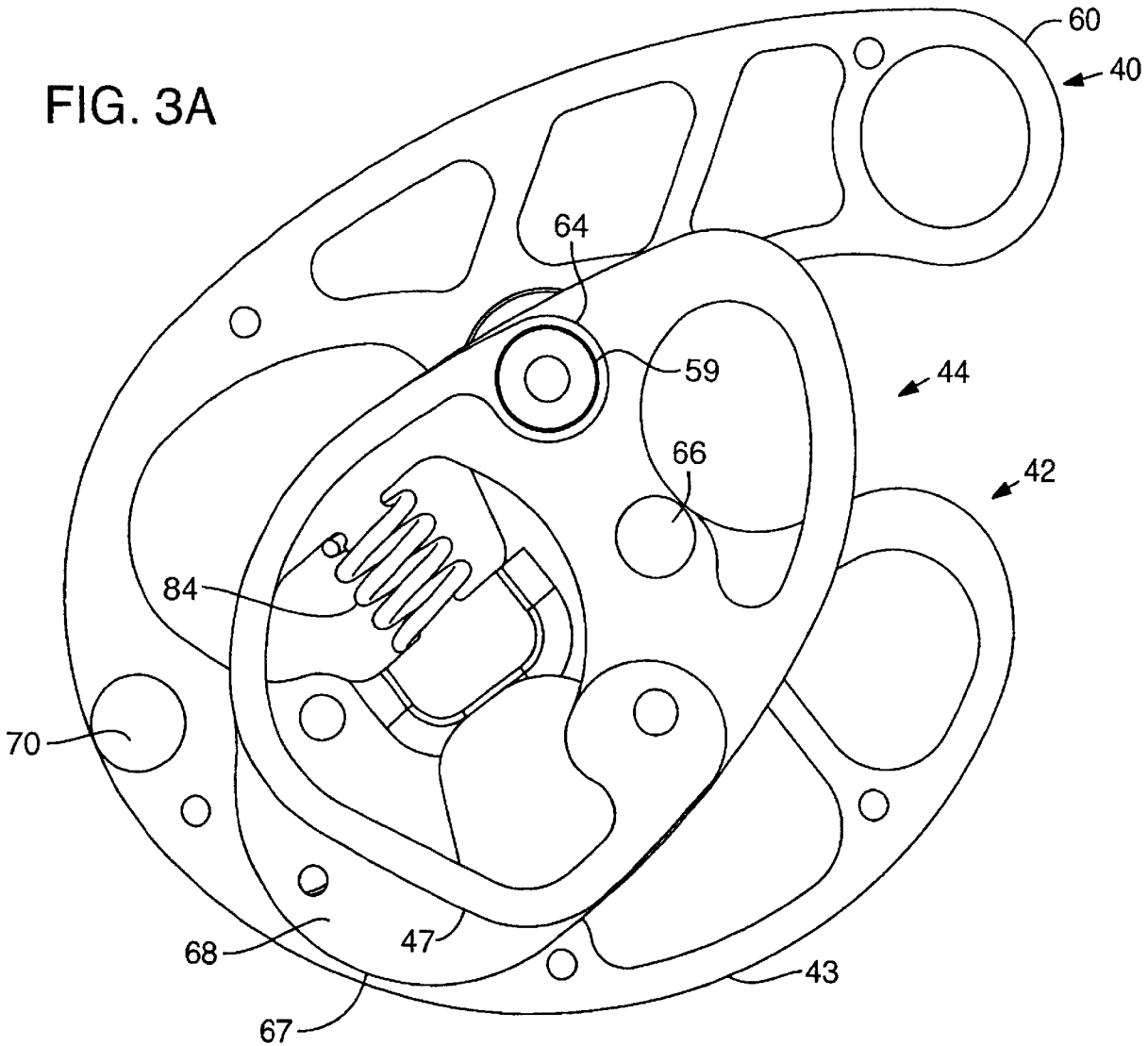
FIG. 3A is a front view of the cam assembly of FIG. 2.
Figure 3B:
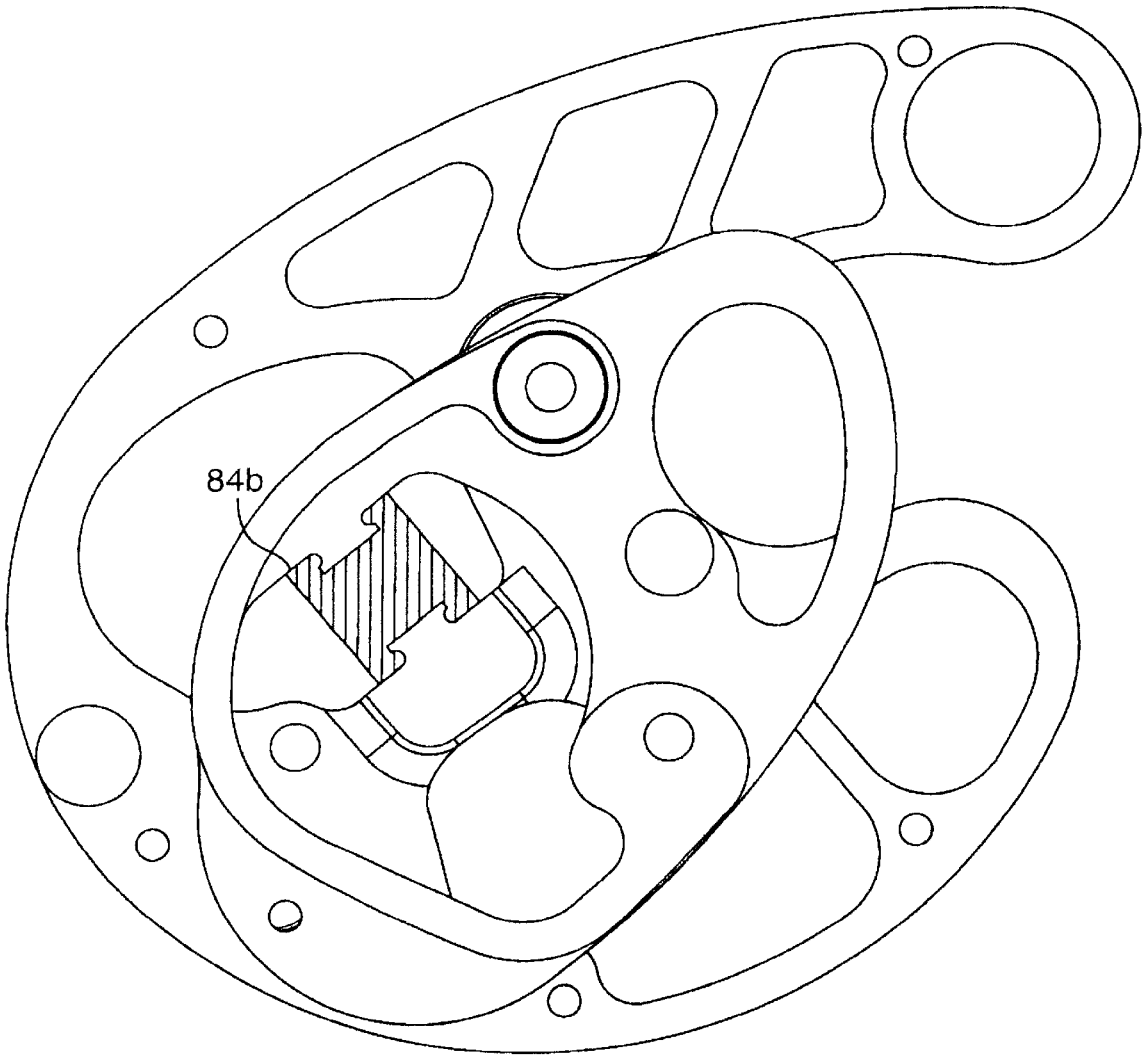
FIG. 3B is a front view of a variant of the cam assembly of FIG. 2.
Figure 3C:
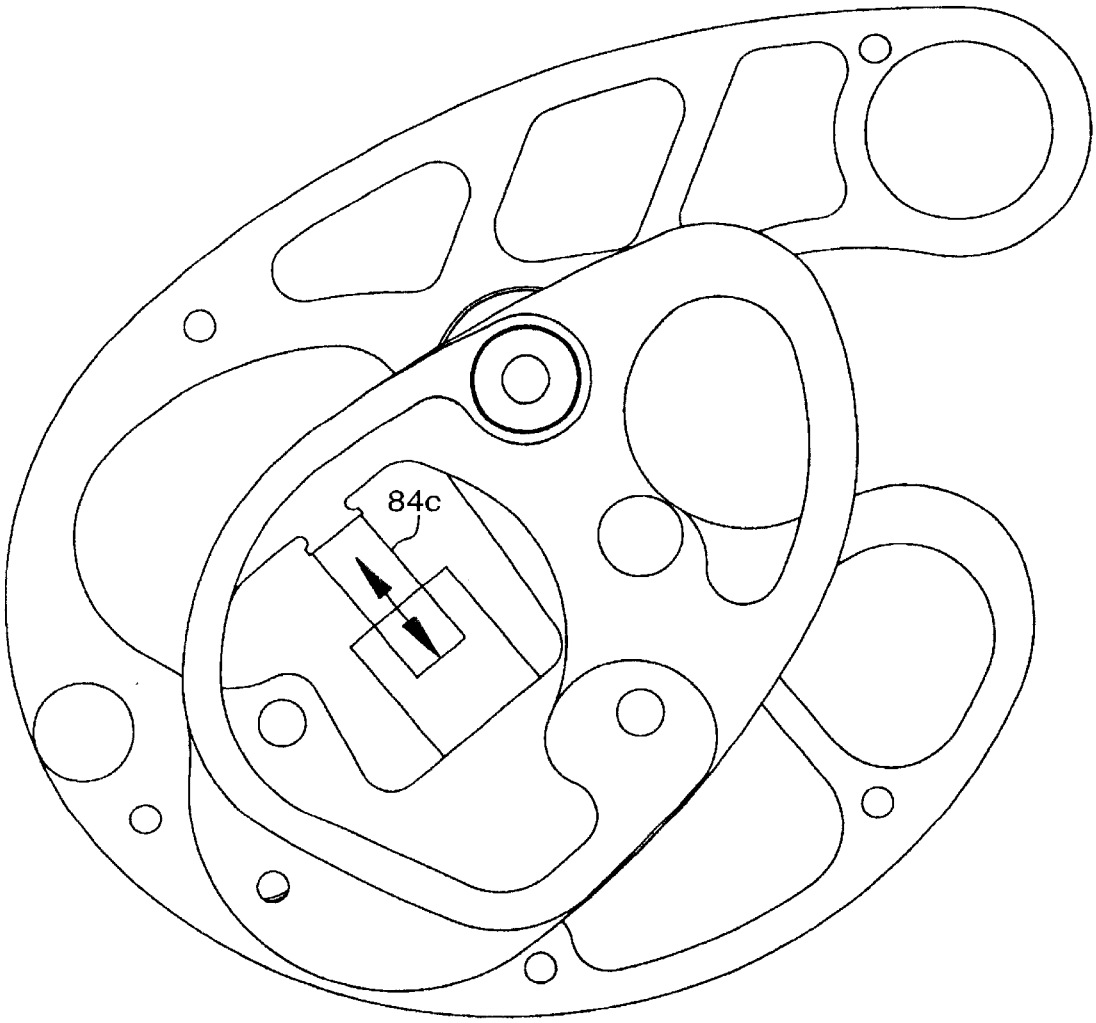
FIG. 3C is a front view of an additional variant of the cam assembly of FIG. 2.
Figure 3D:
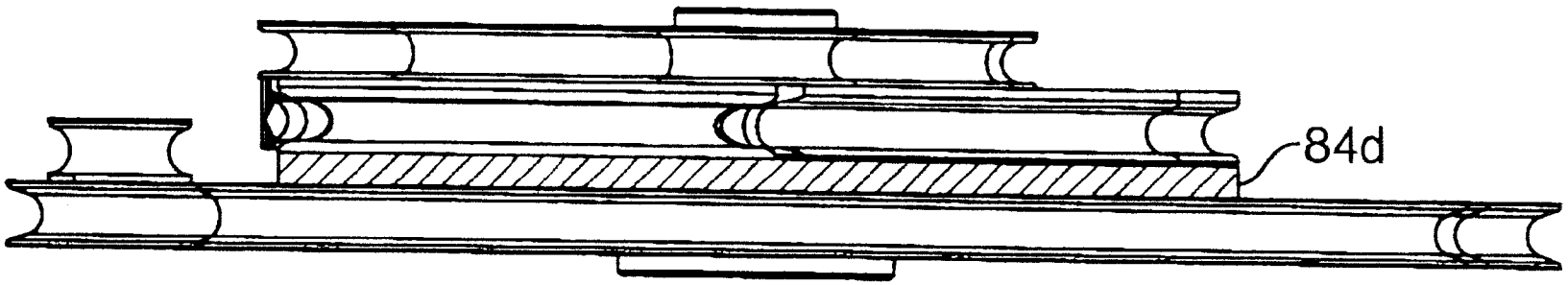
FIG. 3D is a front view of a further variant of the cam assembly of FIG. 2.
Figure 6:
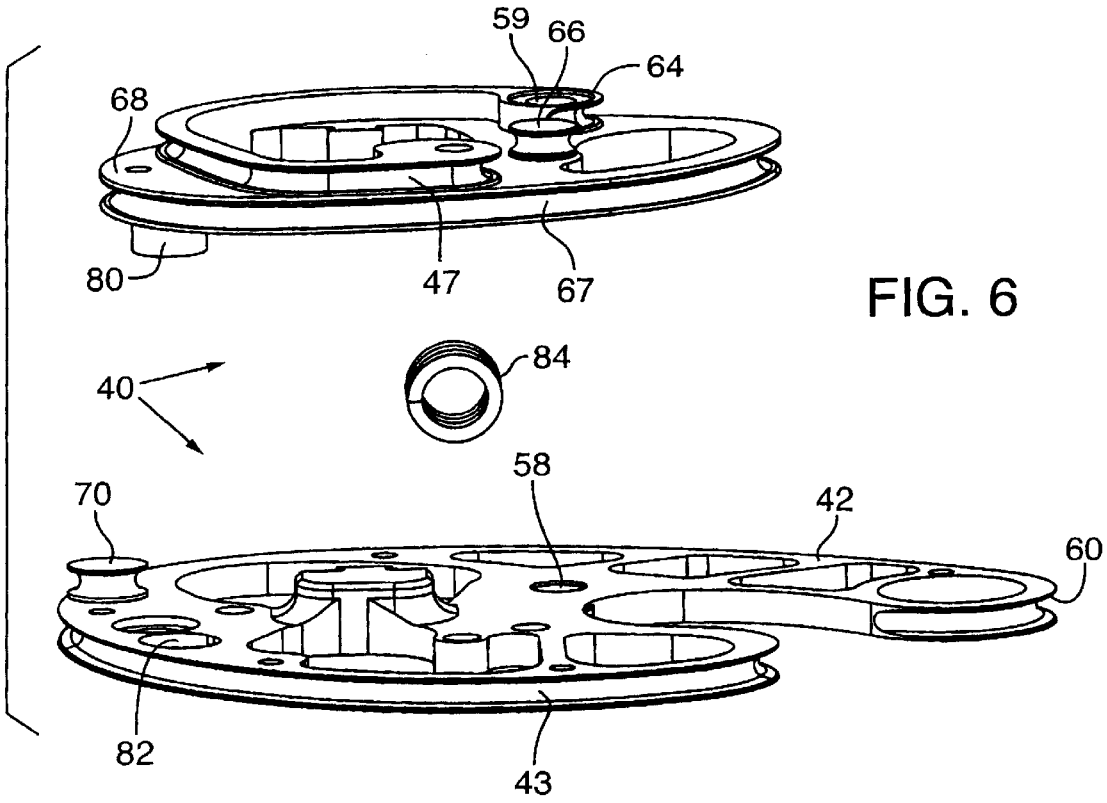
FIG. 6 is an exploded view of the cam assembly of FIG. 2, rotated 180° from the view of FIG. 5
Figure 7:
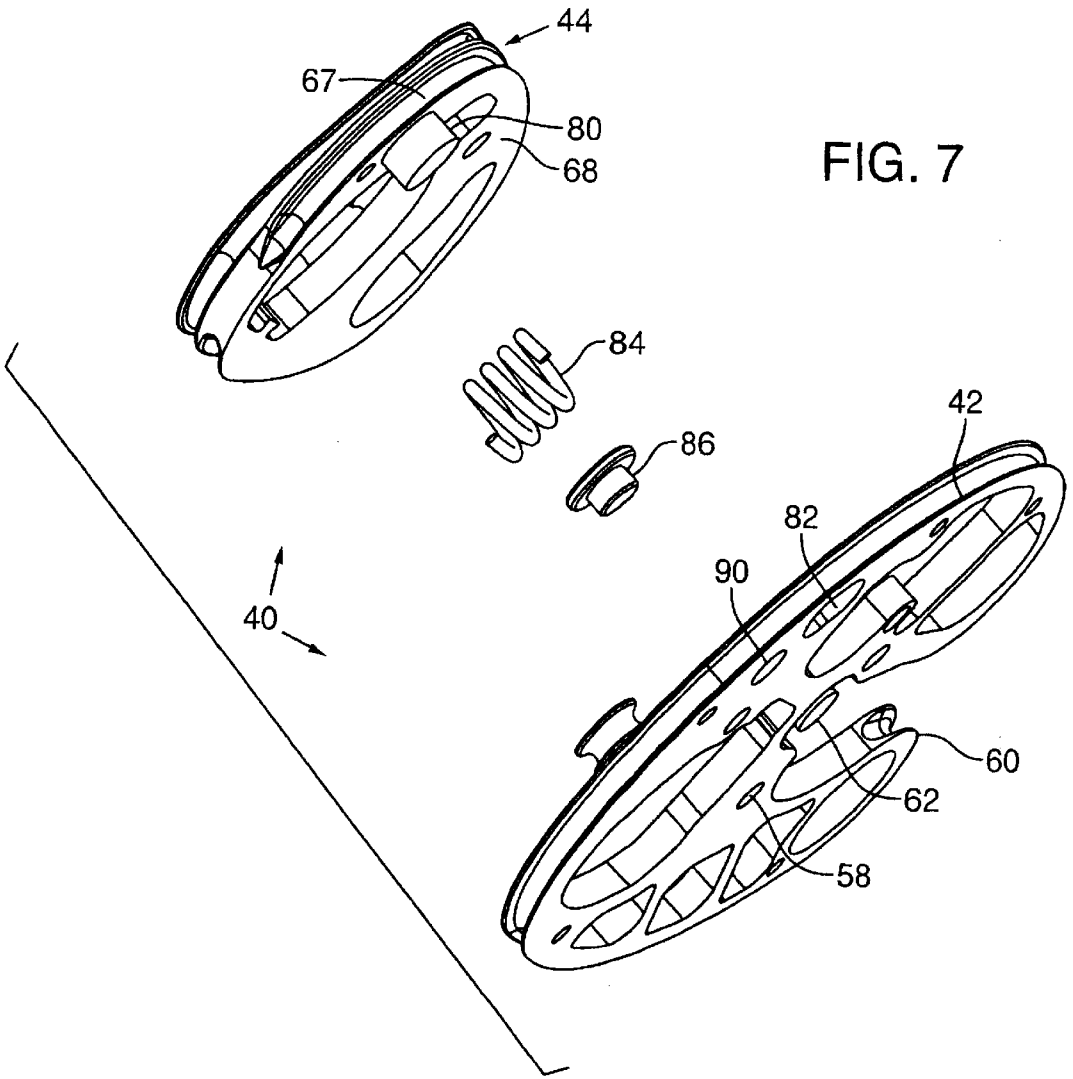
FIG. 7 is an exploded view of the cam assembly of FIG. 2, reoriented with respect to the exploded views of FIGS. 5 and 6.

FIGS. 3A–3D show a number of variants for mechanical energy storage device 84. FIG. 3A shows a coil spring 84, FIG. 3B shows an elastomer spring 84', FIG. 3C shows an air or gas cylinder spring 84" and FIG. 3D shows a torsional elastomer inserted between cams 42 and 44.

In one preferred embodiment, a polymer spacer 86 is fitted through a spacer aperture 88 of primary cam 42, protruding slightly on the side of cam 42 that faces cam 44, thereby separating cams 42 and 44 and providing a low friction surface to facilitate their relative motion.

Figure 8:
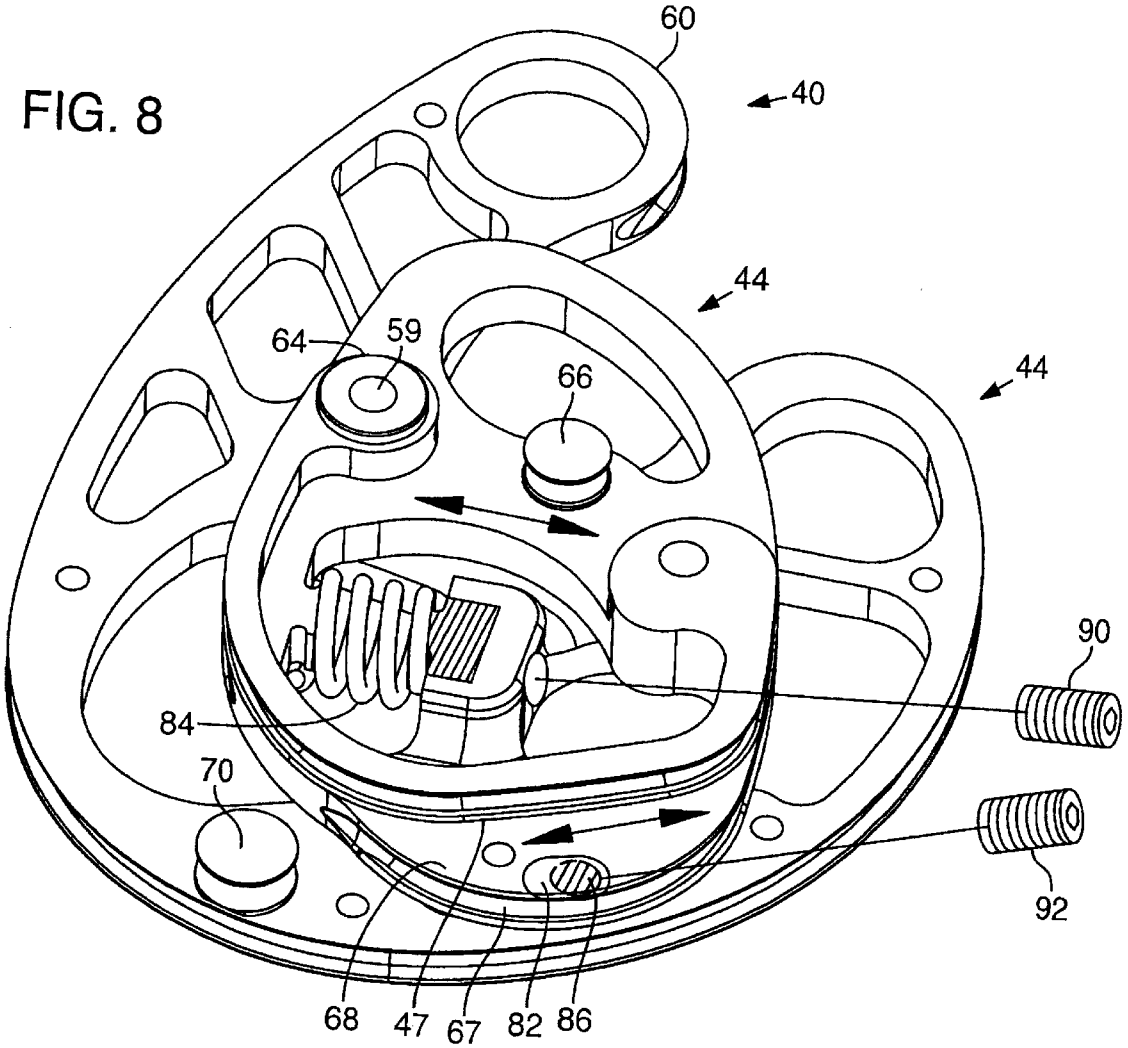
FIG. 8 is a perspective view of an alternative embodiment of a cam assembly according to the present invention.
Figure 9:
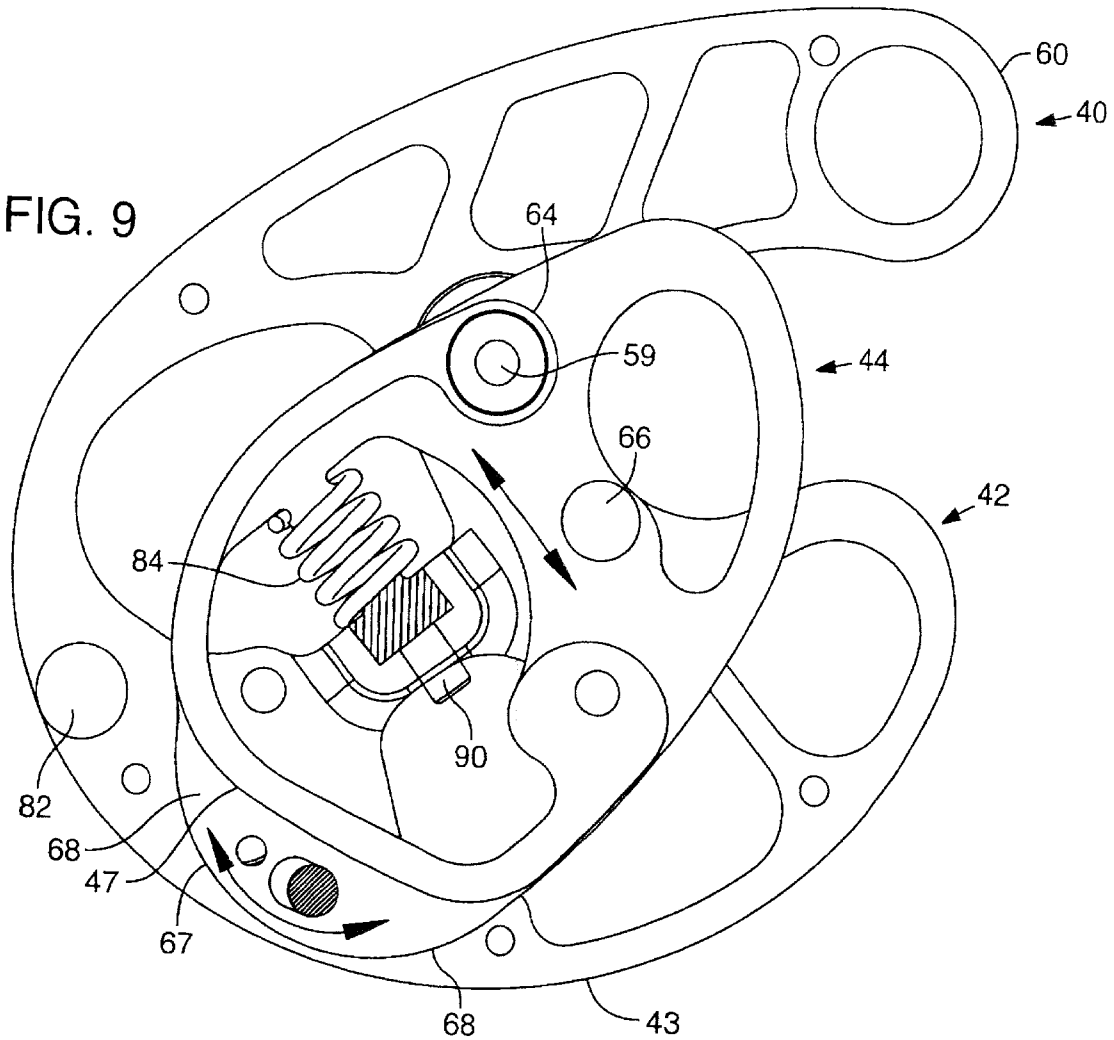
FIG. 9 is a front view of the cam assembly of FIG. 8.
Figure 10:
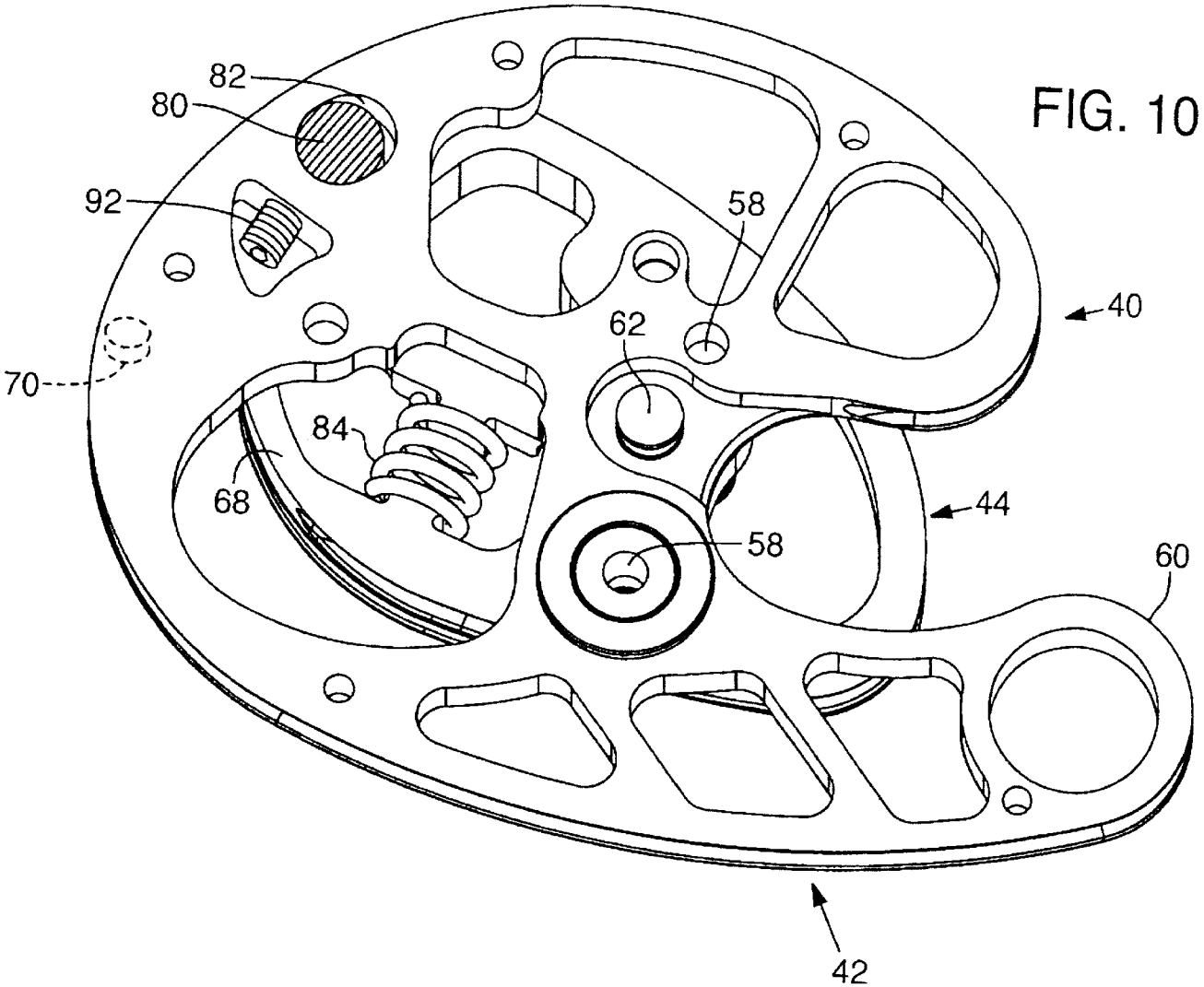
FIG. 10 is a perspective view of the cam assembly of FIG. 8, rotated 180° from the view of FIG. 8.
Figure 11:
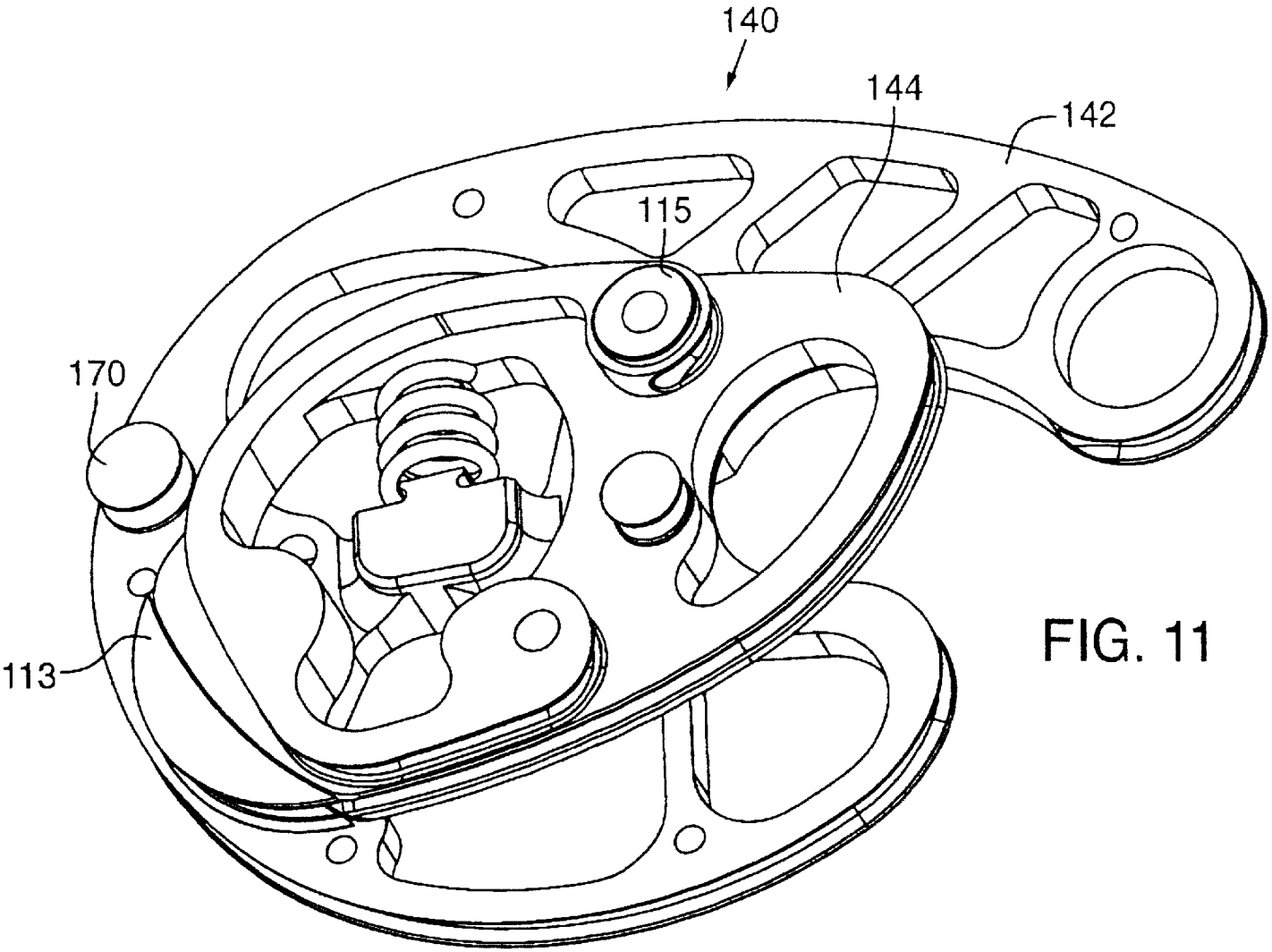
FIG. 11 is a perspective view of an additional alternative embodiment of a cam assembly according to the present invention.
Figure 12:
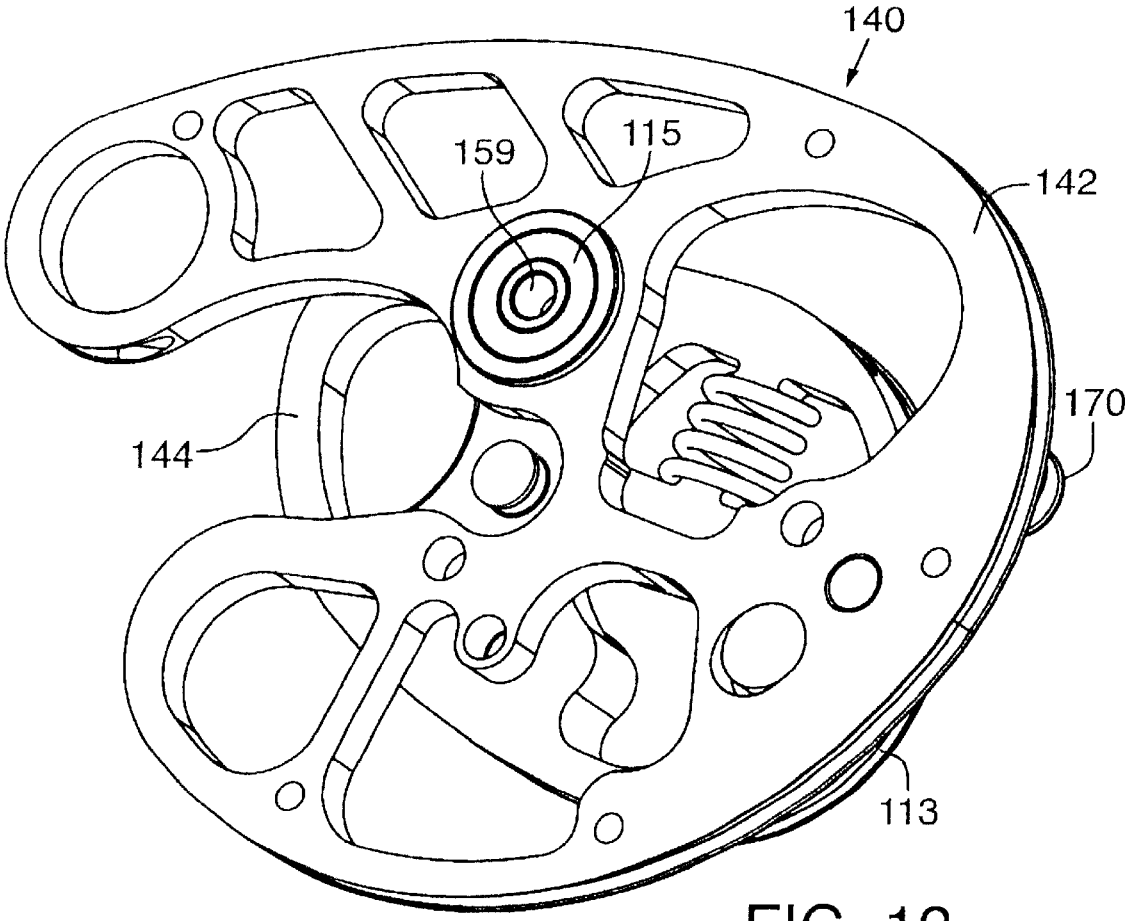
FIG. 12 is a perspective view of the cam assembly of FIG. 10, rotated 180° from the view of FIG. 10.
Figure 13:
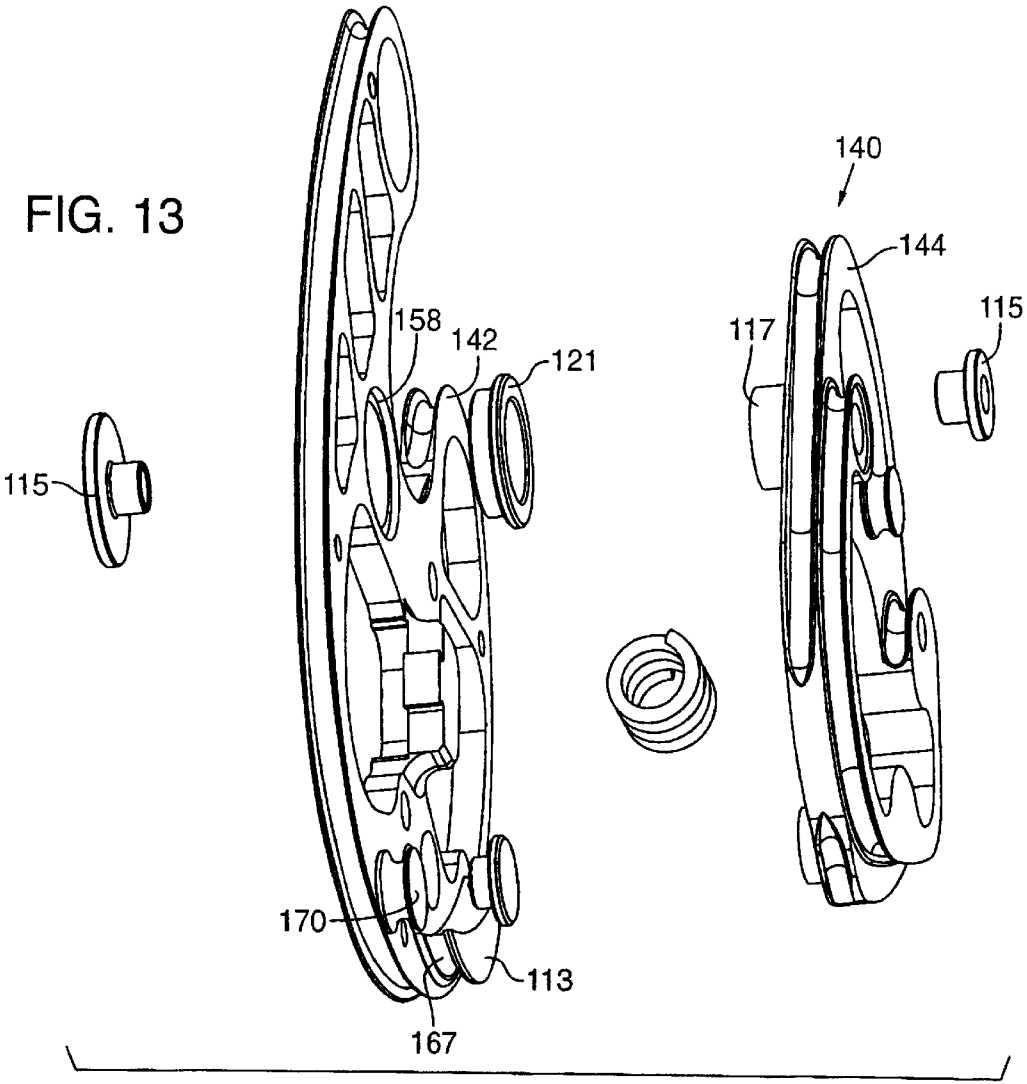
FIG. 13 is a rotated and exploded perspective view of the cam assembly of FIG. 11.
Figure 14:
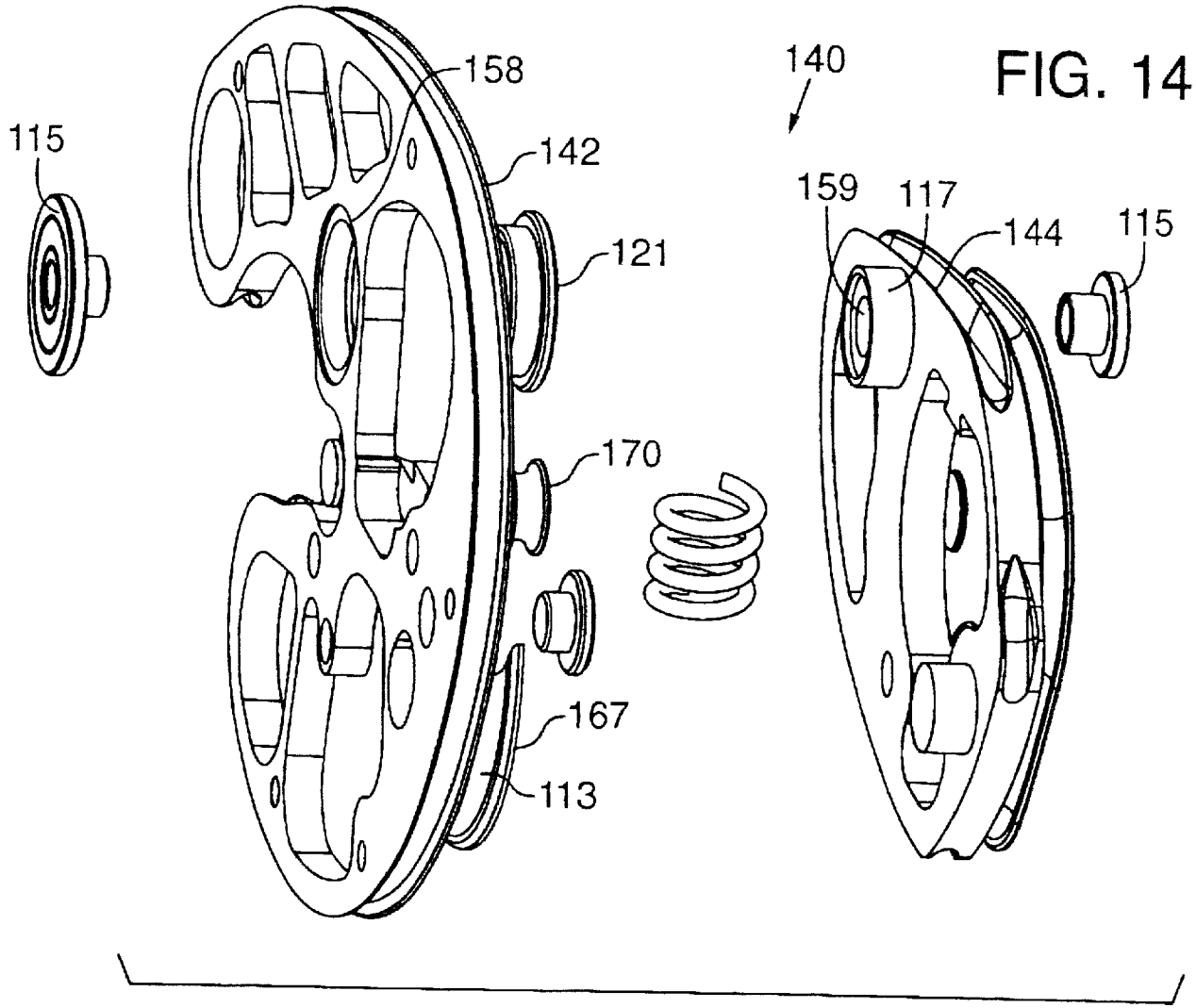
FIG. 14 is a rotated and exploded perspective view of the cam assembly of FIG. 11, rotated 180° from the view of FIG. 13.
Figure 15:
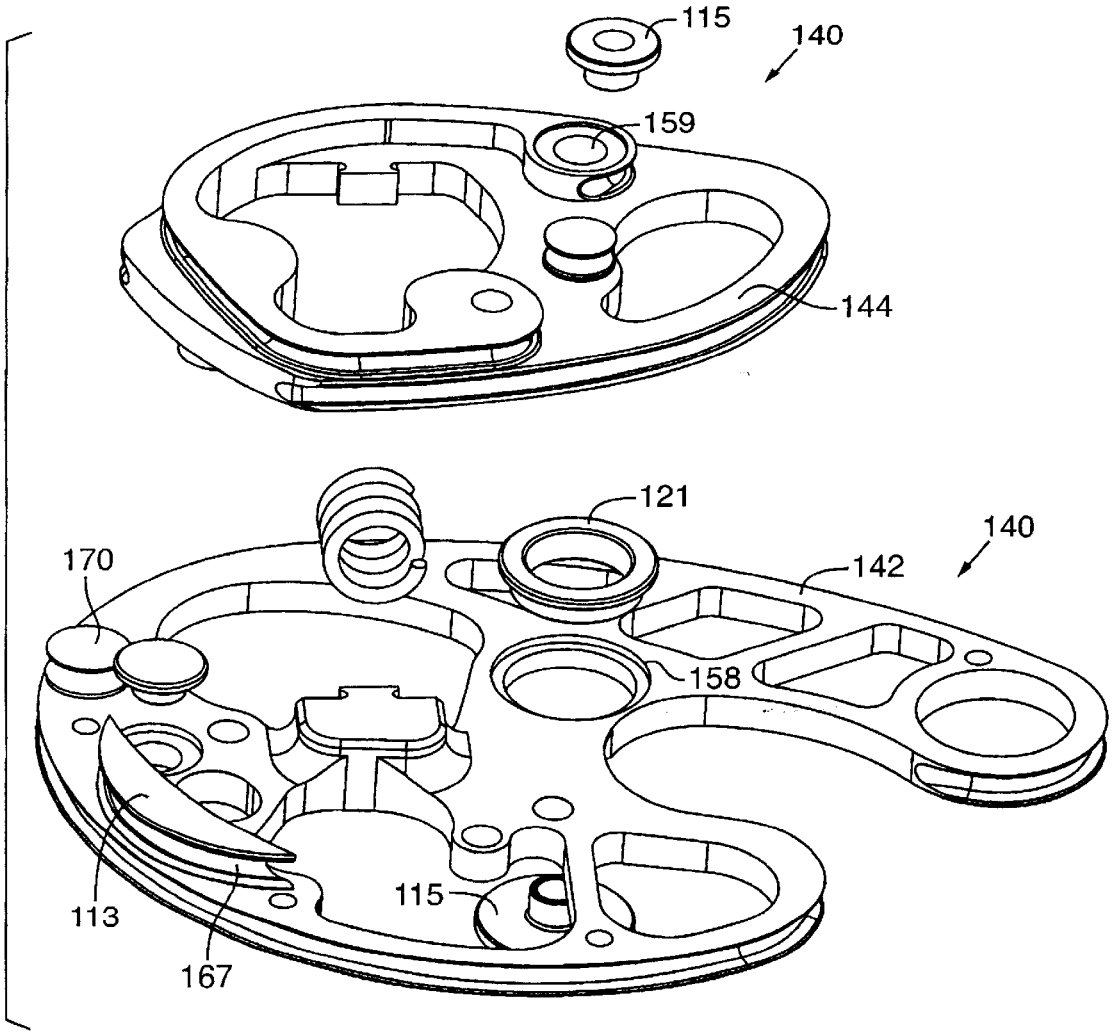
FIG. 15 is a rotated and exploded perspective view of the cam assembly of FIG. 11, rotated 180° from the view of FIG. 14.
Figure 16:
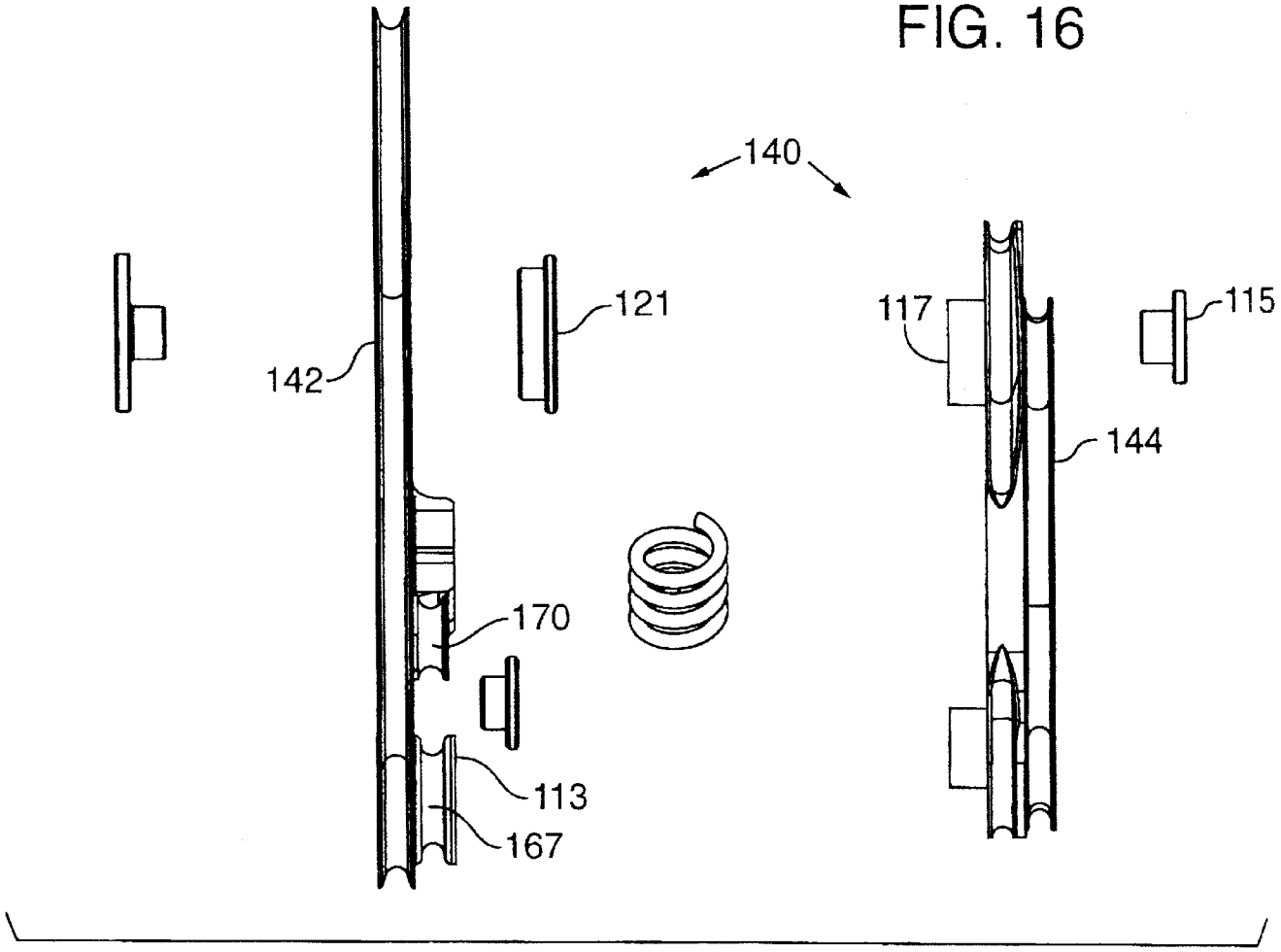
FIG. 16 is an exploded side view of the cam assembly of FIG. 11.

In an additional preferred embodiment, shown in FIGS. 8–10, the tension on spring 84 is adjustable by way of a first setscrew 90. In addition the range of travel possible between cams 42 and 44 is adjustable by way of a second setscrew 92.

It should be noted that although spring 84 is shown as a coil spring, any form of mechanical energy storage device that would fit in the prescribed volume could be used.

Referring to FIGS. 11 through 17 in a second preferred embodiment of a cam assembly 140 (like elements with the first embodiment are given the same element number plus 100) an island boss 113 projects laterally outwardly from primary cam 142 and is free to move relative to the secondary cam 144. This arrangement avoids the problem of friction between the secondary cam 144 and the anchor cable 56 when the bow is drawn.

In addition, an axle bushing 115 is provided to facilitate movement of cam assembly 140 about the bottom axle 24. Moreover, primary cam 142 is mounted at a round opening 158 about an axle boss 117 of the secondary cam 144. Axle boss 117 defines a through-hole 159 to permit mounting about axle 24. A circular separator 121 provides a low friction surface to facilitate relative movement between cams 142 and 144.

Figure 17:
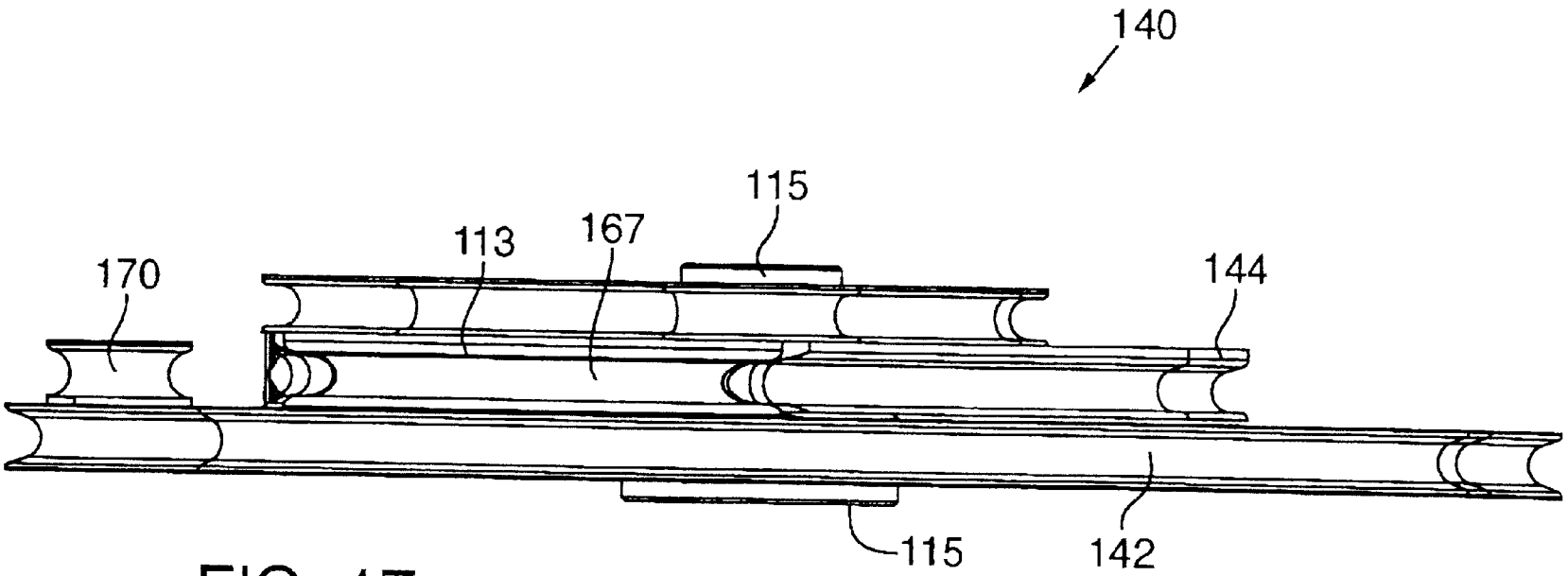
FIG. 17 is a side view of the cam assembly of FIG. 11.
Figure 18:
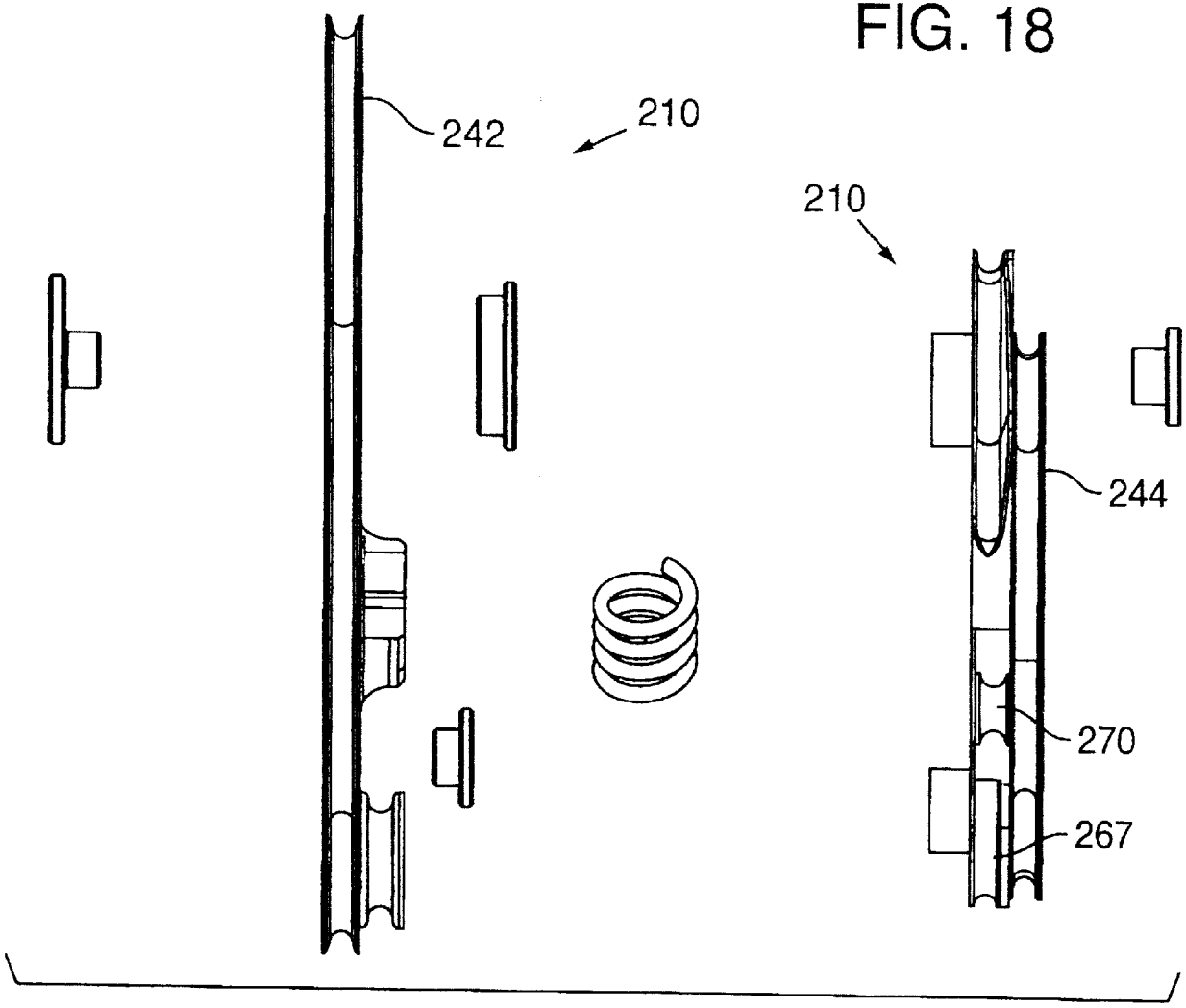
FIG. 18 is an exploded side view of an additional alternative embodiment of a cam assembly according to the present invention.
Figure 19:
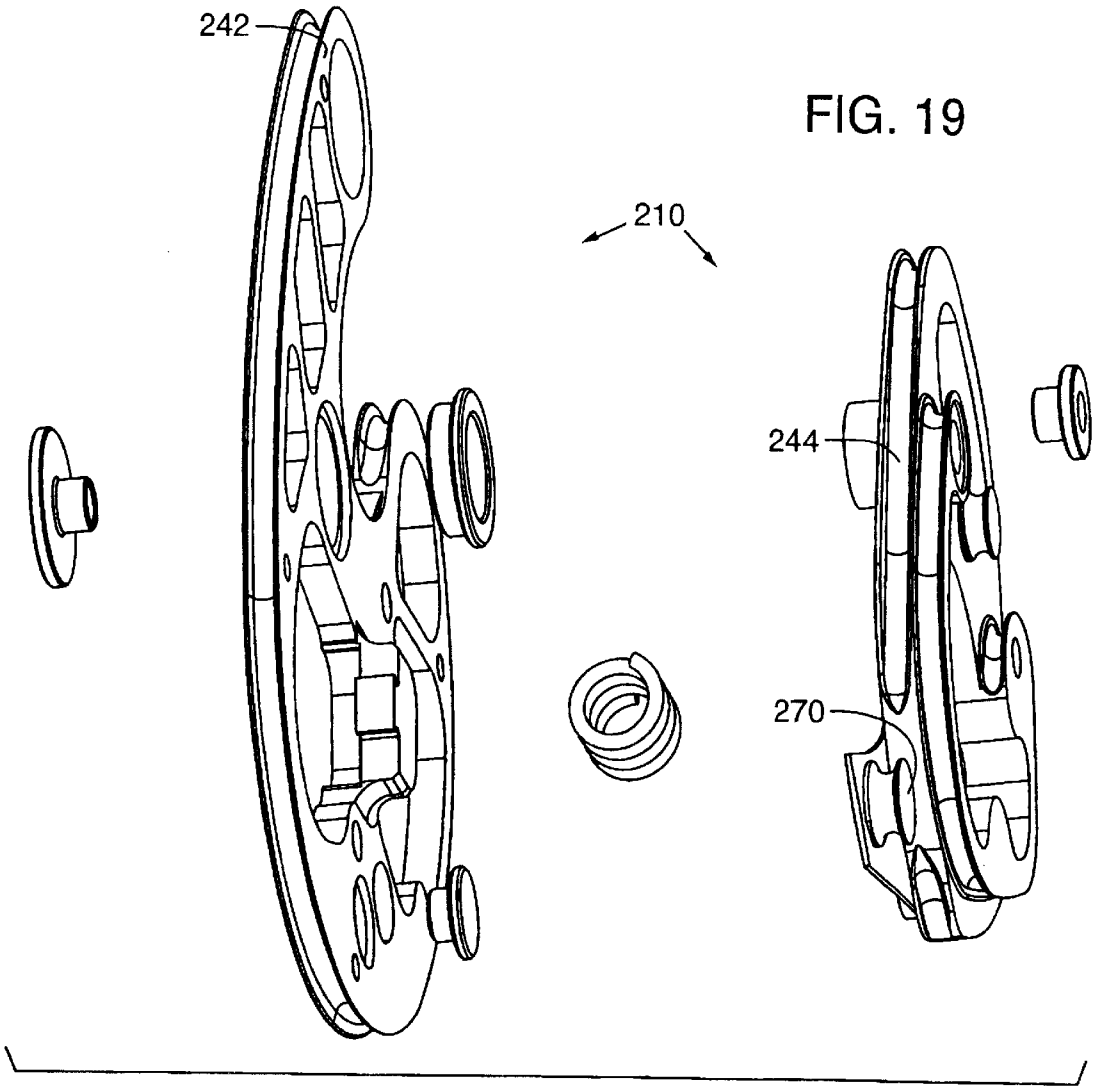
FIG. 19 is an exploded perspective view of the cam assembly of FIG. 18.

Referring to FIGS. 17–19, in a third preferred embodiment, the anchor cable pin 270 has been moved from the primary cam onto the secondary cam 244. With this embodiment, there is no friction between secondary cam 244 and anchor cable 56 when the secondary cam 244 moves relative to the primary cam 242, as there is in the first preferred embodiment. Moreover, in the second preferred embodiment there is some potential for friction between the island boss 113 and the secondary cam 144. As the island boss 113 is eliminated in the third preferred embodiment, there is no potential for this type of friction either.

Figure 20A:
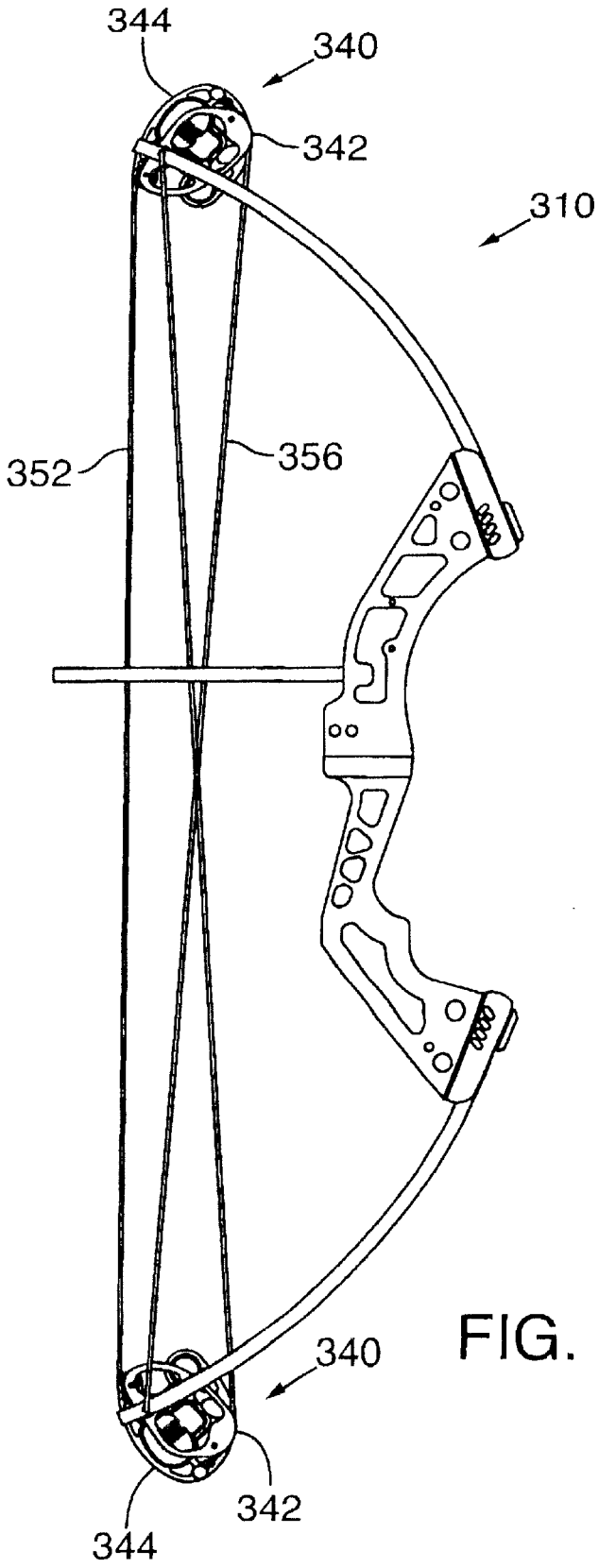
FIG. 20A is an alternative preferred embodiment of an archery bow according to the present invention and having a matching cam assembly on either limb.
Figure 20B:
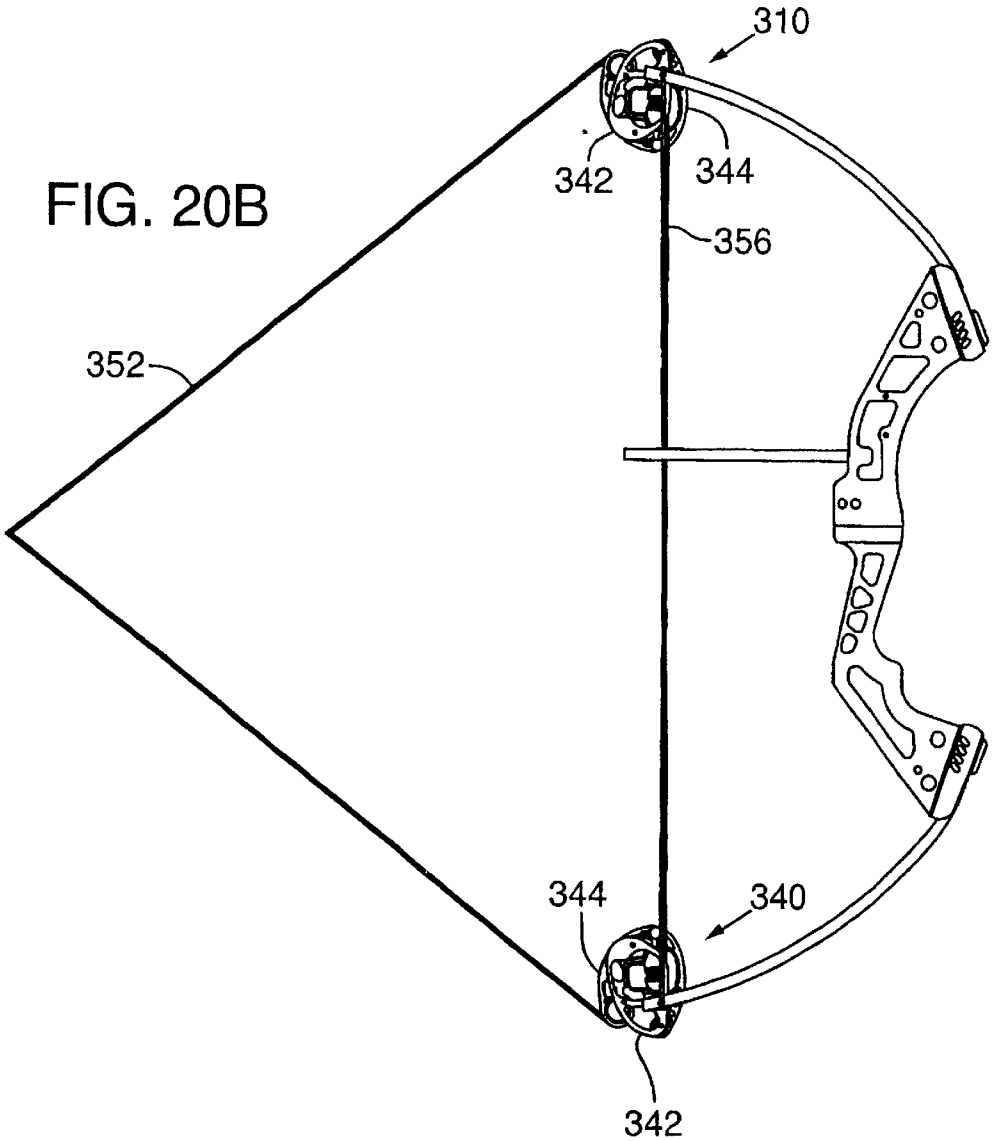
FIG. 20B is a side view of the archery bow of FIG. 2A, in drawn position.
Figure 21:
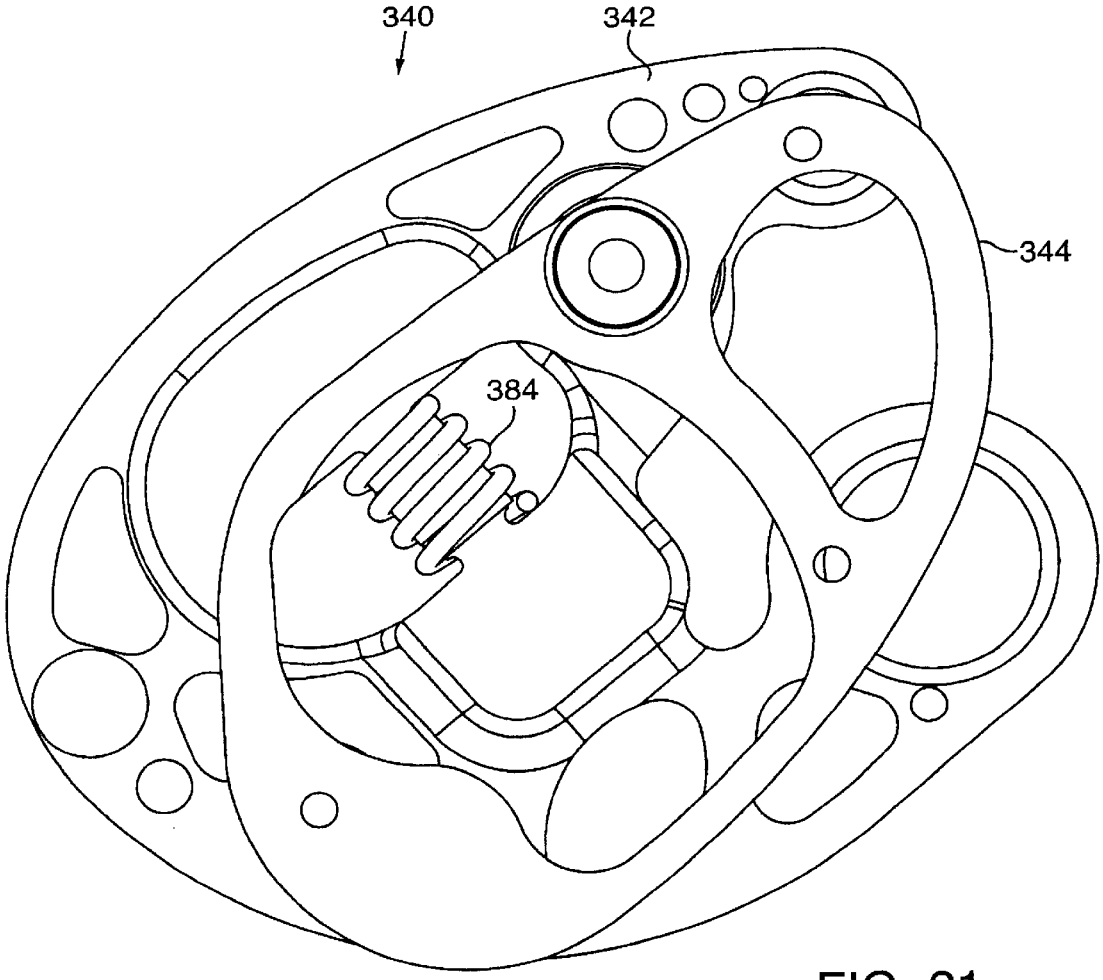
FIG. 21 is a front view of the cam assembly used in the archery bow of FIGS. 20A and 20B.

Referring to FIGS. 20A, 20B and 21, a fourth preferred embodiment includes an identical cam assembly 340 on either split limb of an archery bow 310. In this instance, the primary cam 342 feeds out the bowstring 352 as the archery bow 310 is being drawn and while the secondary cam 344 pulls in the anchor cable 356. There is no return cable section, such as return cable section 54 of the first embodiment. Again, however, there is a limited freedom of movement between cams 340 and 342 and a mechanical energy storage device 384 which stores energy diverting the draw and releases energy on the shoot.

Figure 22A:
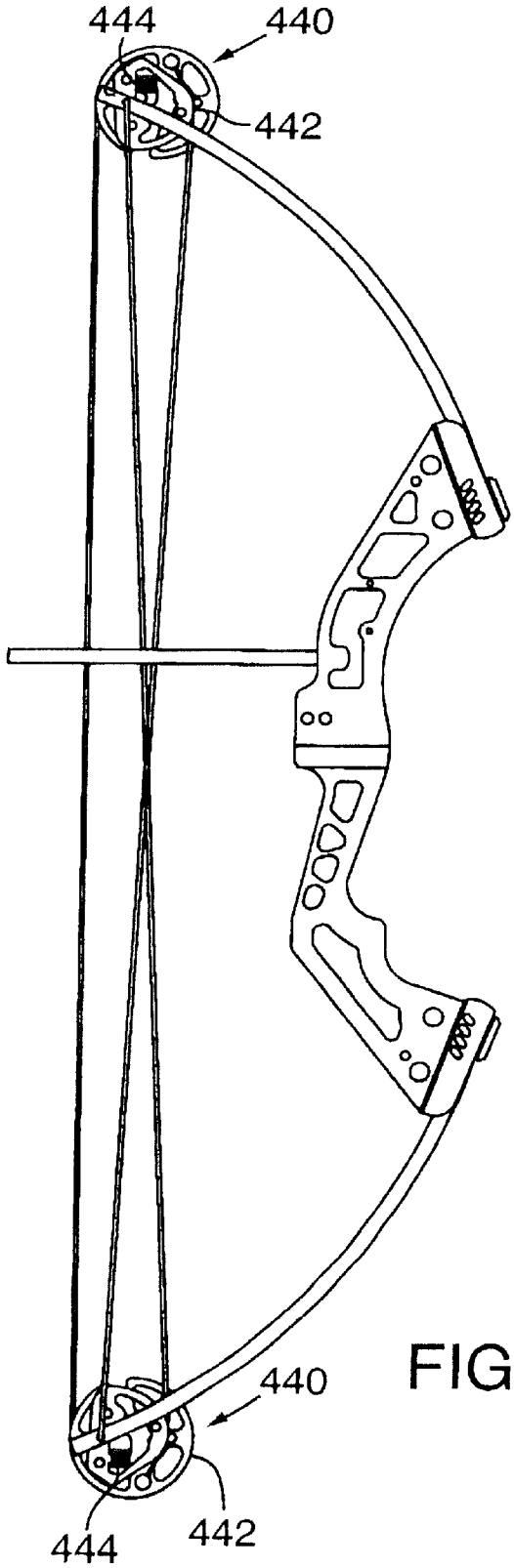
FIG. 22A is a side view of an alternative preferred embodiment of an archery bow according to the present invention, and having a matching wheel assembly on either limb.
Figure 22B:
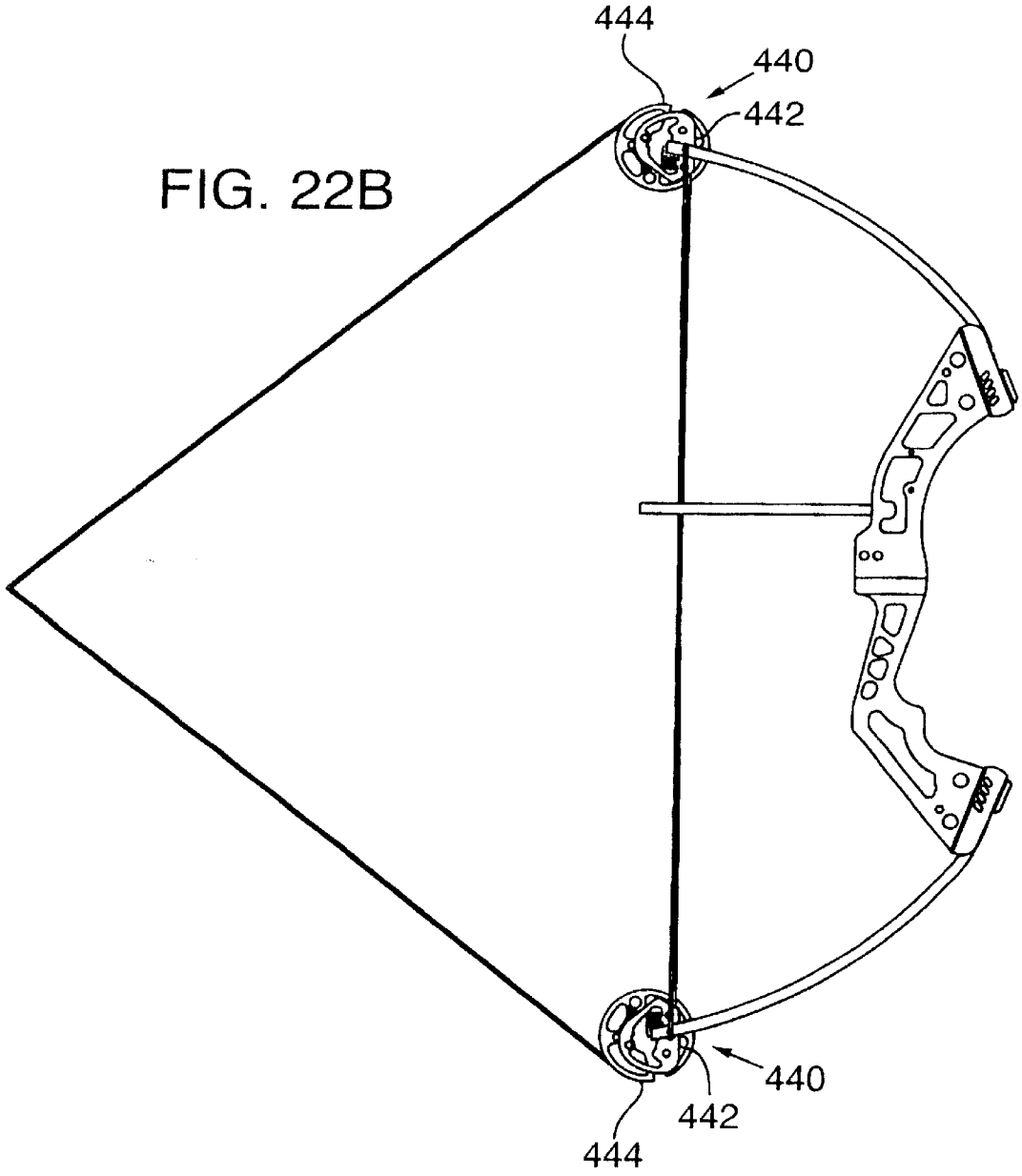
FIG. 22B is a side view of the archery bow of FIG. 22A, in drawn position.

Referring to FIGS. 22A and 22B, a fifth preferred embodiment of an archery bow 410 is quite similar to bow 310 but includes round wheel assembly 440 mounted on either end of the bow, instead of cam assemblies 340. Similar to the previous embodiment, a primary wheel 442 and a secondary wheel 444 are allowed limited rotational freedom of movement relative to each other. This freedom of movement is resisted as the bow is being drawn by a spring 484, which releases the energy stored on the shoot.

Figure 23A:
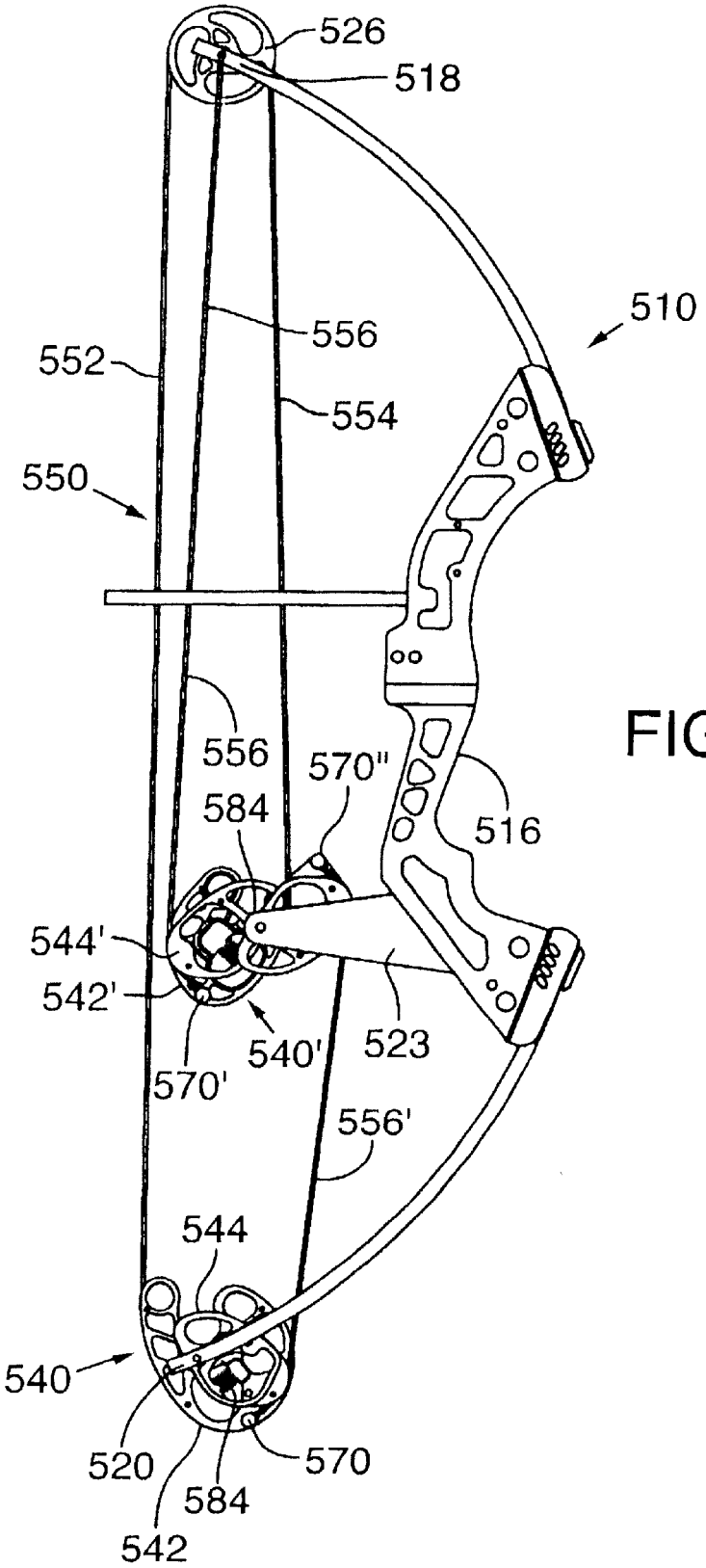
FIG. 23A is a side view of an additional alternative embodiment of an archery bow according to the present invention.
Figure 23B:
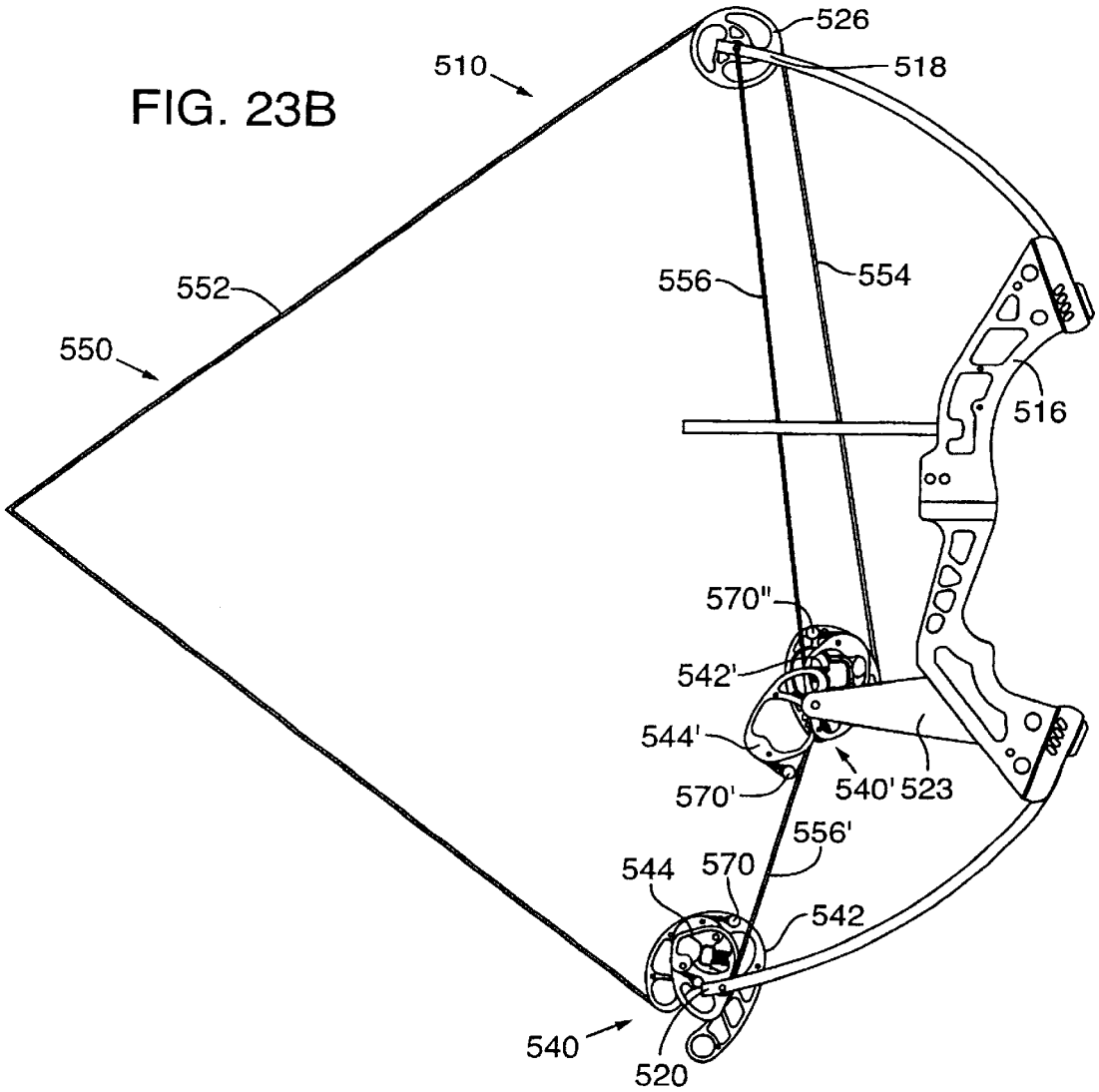
FIG. 23B shows the same view of the same bow as FIG. 23A, but with the bowstring drawn.

Referring to FIGS. 23*a* and 23*b*, a sixth preferred embodiment of an archery bow 510 includes a first cam assembly 540 mounted to the bottom mounting fork 520 and a second cam assembly 540' mounted on a mounting fork 523 attached to the riser 516. A bowstring cable 550 is anchored at first cam assembly 540 in the same manner as with cam assembly 40 in the first preferred embodiment, extends about primary cam 542 and upwards to the pulley 526 (this portion is designated as the bowstring 552), which it is trained about. Cable 550 then extends downwardly in a return cable portion 554, which is anchored in like manner to second cam assembly 540'. In addition, a first anchor cable 556 extends from a top mounting fork 518 to anchor pin 570' on second cam assembly 540'. In addition a second anchor cable 556' extends from pin 570" to pin 570 on first cam assembly 540. A first spring 584 stores energy between first primary cam 542 and second secondary cam 544 and a second spring 584' stores energy between second primary cam 542' and second secondary cam 544'.

Referring to FIG. 23*b*, when archery bow 510 is drawn, cam assembly 540 rotates in a clockwise direction and cam assembly 540' rotates in a counterclockwise direction. Accordingly bowstring cable 550 is let out by both cam assembly 540 and cam assembly 540' and first anchor cable 556 is reeled in by cam assembly 540'. The second anchor cable 556' is reeled in by both cam assembly 540 and cam assembly 540'.

Figure 24:
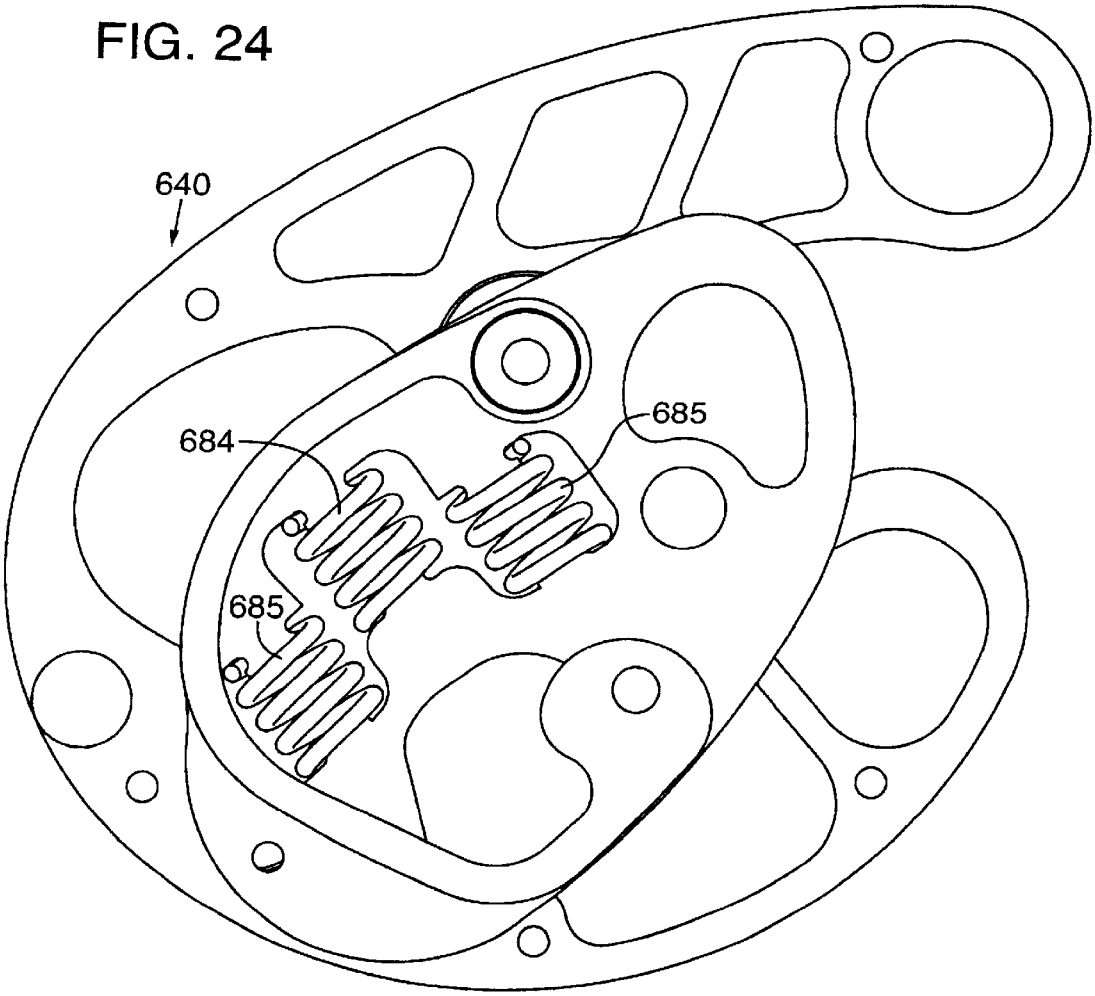
FIG. 24 is a front view of a further additional alternative embodiment of a cam assembly according to the present invention.
Figure 25:
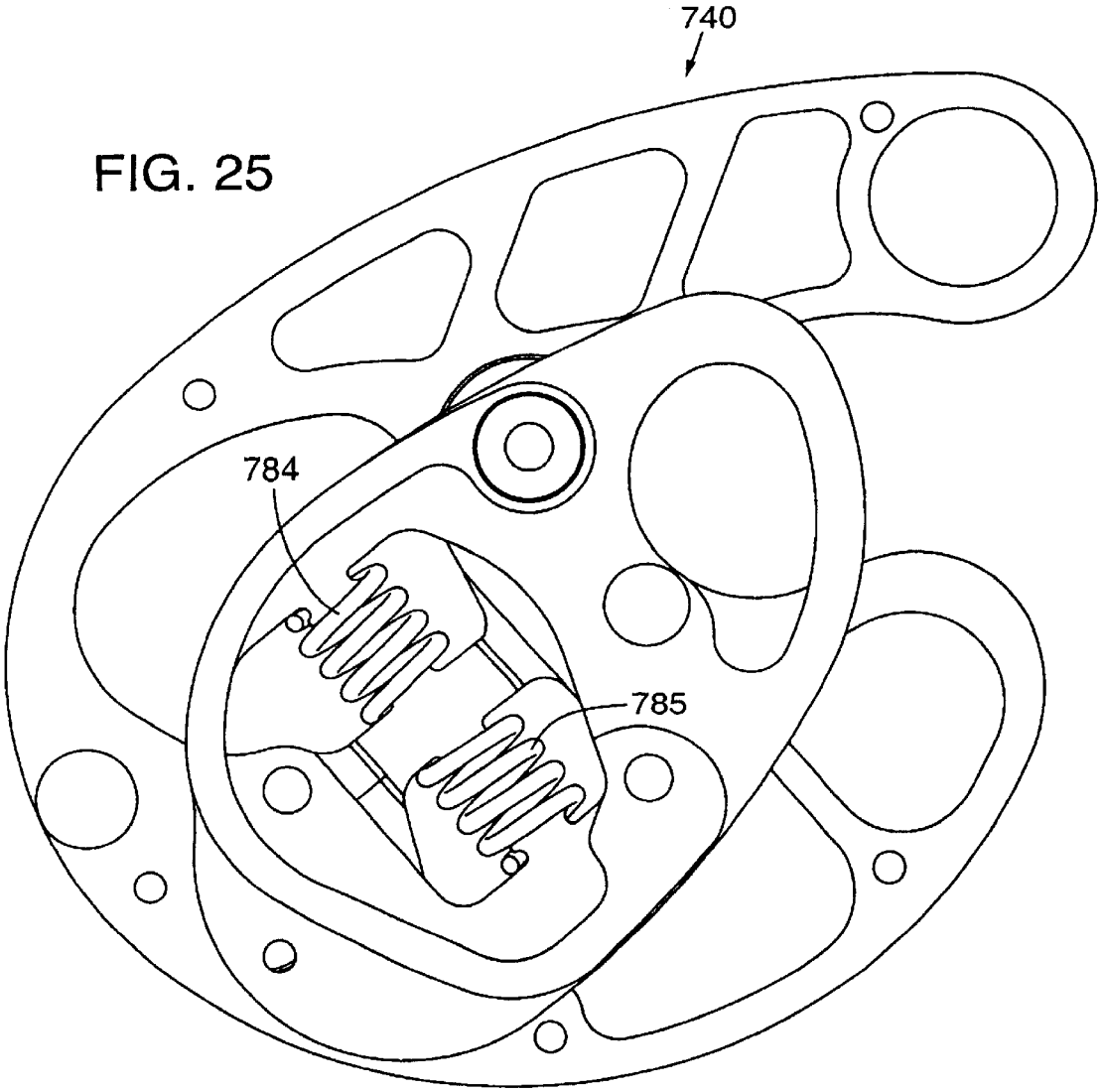
FIG. 25 is a front view of a further additional alternative embodiment of a cam assembly according to the present invention.
Figure 26:
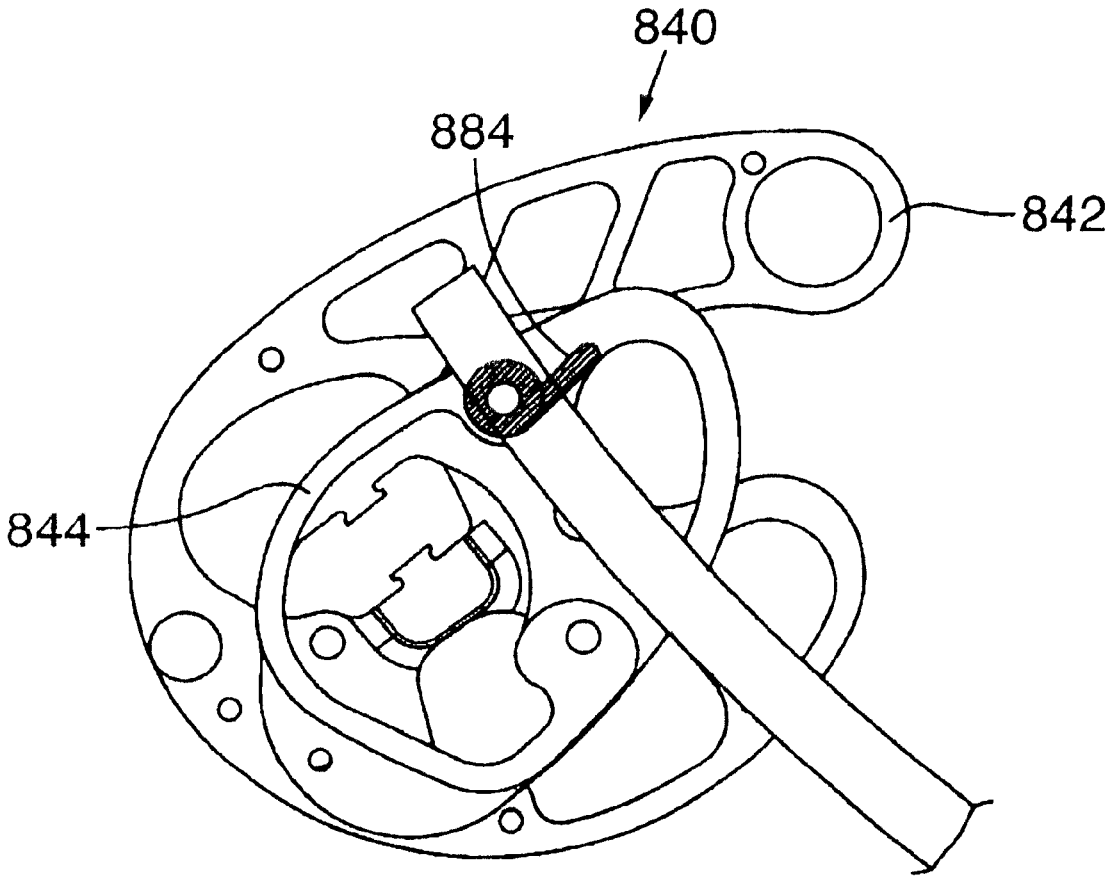
FIG. 26 is a front view of a further additional alternative embodiment of a cam assembly according to the present invention.
Figure 27:
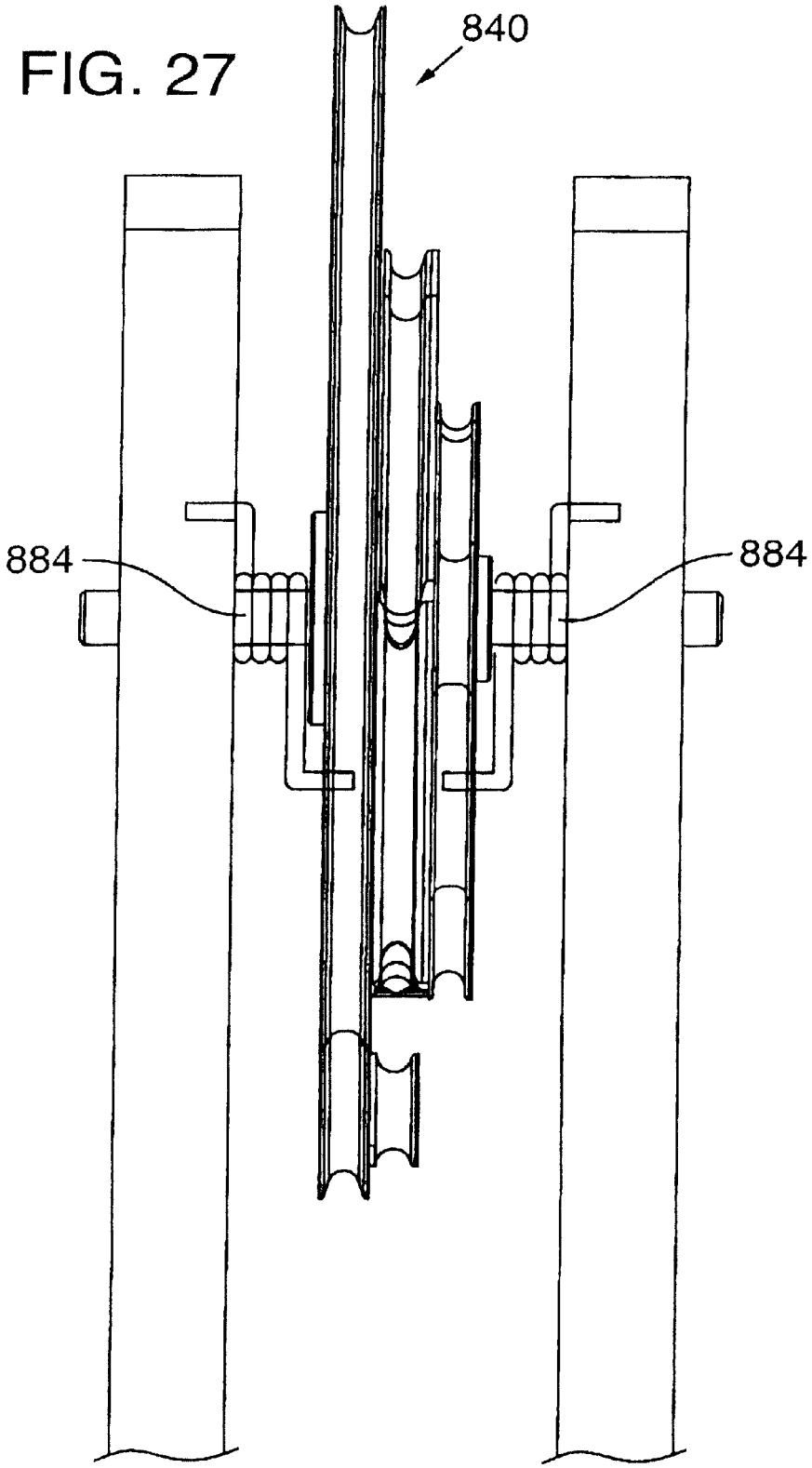
FIG. 27 is a side view of the cam assembly of FIG. 26.
Figure 28:
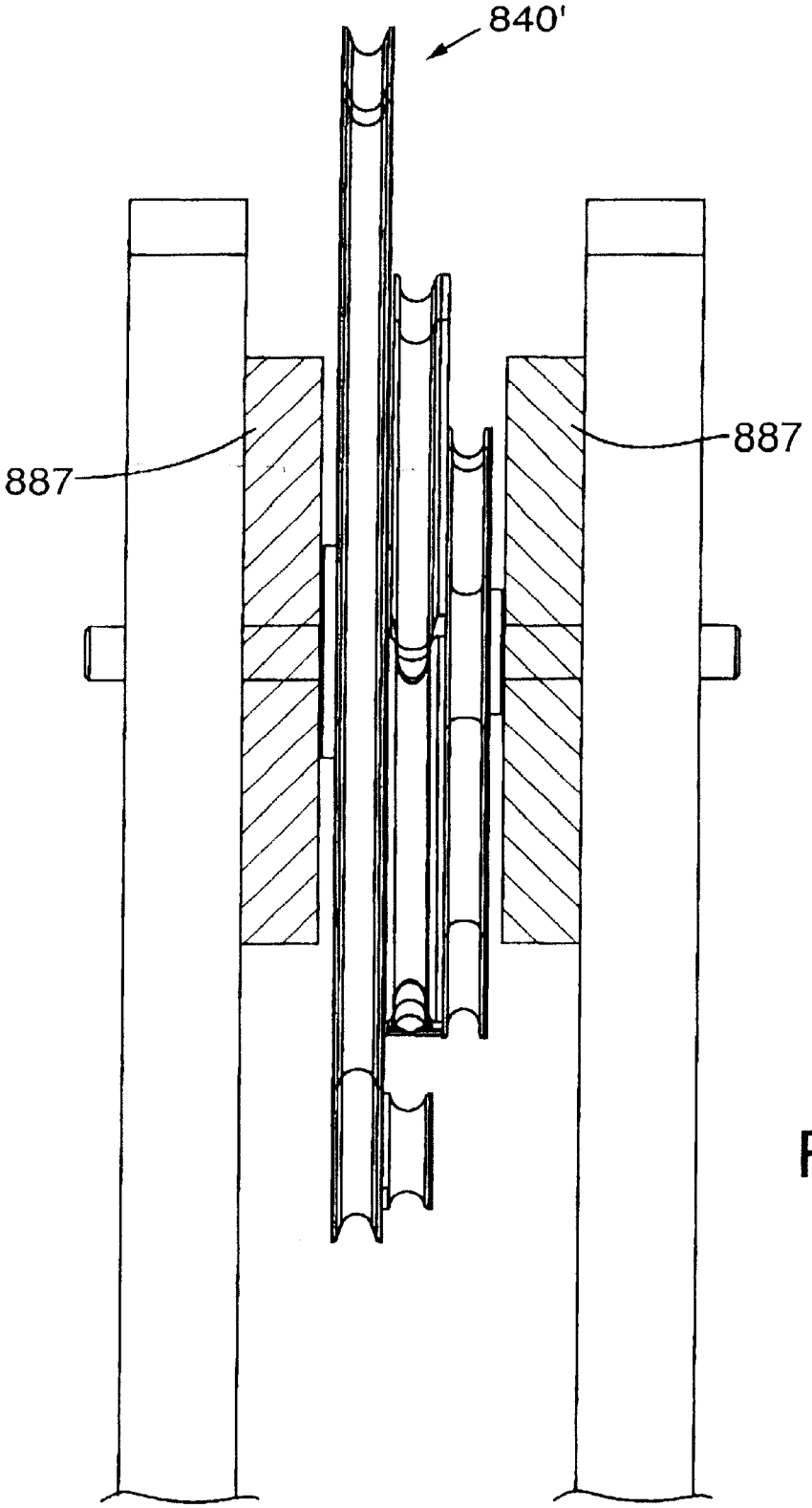
FIG. 28 is a side view of a further additional alternative embodiment of a cam assembly according to the present invention.

FIGS. 24–28 detail various different mechanical storage type and placement variants. It must be emphasized that the full range of mechanical storage types fit within the scope of the invention. This includes, but is not limited to, coil springs, torsional springs, neoprene springs and gas cylinders. FIG. 24 shows a cam assembly 640 having a spring system including a central spring 684 and a pair of outrigger springs 685 designed to dampen the vibrations by the release of central spring 684. FIG. 25 shows a cam assembly 740 having a spring system made up of a primary spring 784 designed principally for energy storage and a secondary spring 785 designed principally to dampen the vibrations caused by the rapid release of primary spring 784. FIGS. 26 and 27 show a cam assembly 840, that is similar to cam assembly 140, but mounting a pair of coiled torsional springs 884 that are also mounted at either tyne of bottom mounting fork 20. In this variant energy is stored in the rotation of cams 742 and 744. In a slight variant shown in FIG. 28, coiled torsional springs 884 are replaced by elastomeric torsional springs 887.

Figure 29:
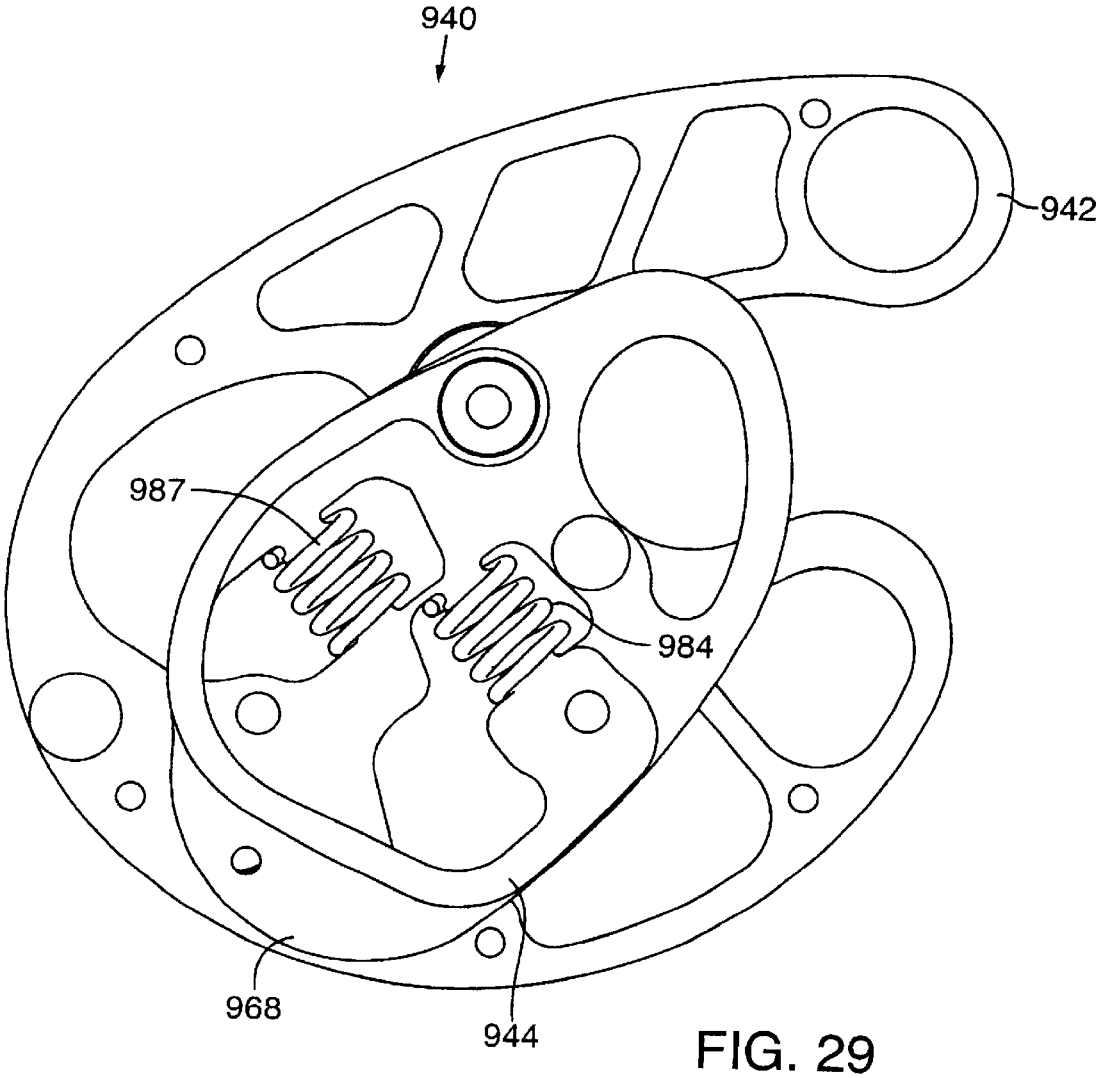
FIG. 29 is a front view of a further additional alternative embodiment of a cam assembly according to the present invention.

FIG. 29 shows an embodiment in which a primary cam 942, a secondary cam 944 and a module 968 (defining an anchor cable track 967) are all permitted a limited freedom of movement relative to one another. This is a departure from the first embodiment in which the secondary cam 44 included the module 68 as a fixed element. A first spring 984 stores energy as the secondary cam 944 is moved relative to the module 968 during the bowstring draw and a second spring 987 stores energy as the primary cam 942 is moved relative to the module 968, also during the bowstring draw.

Figure 30:
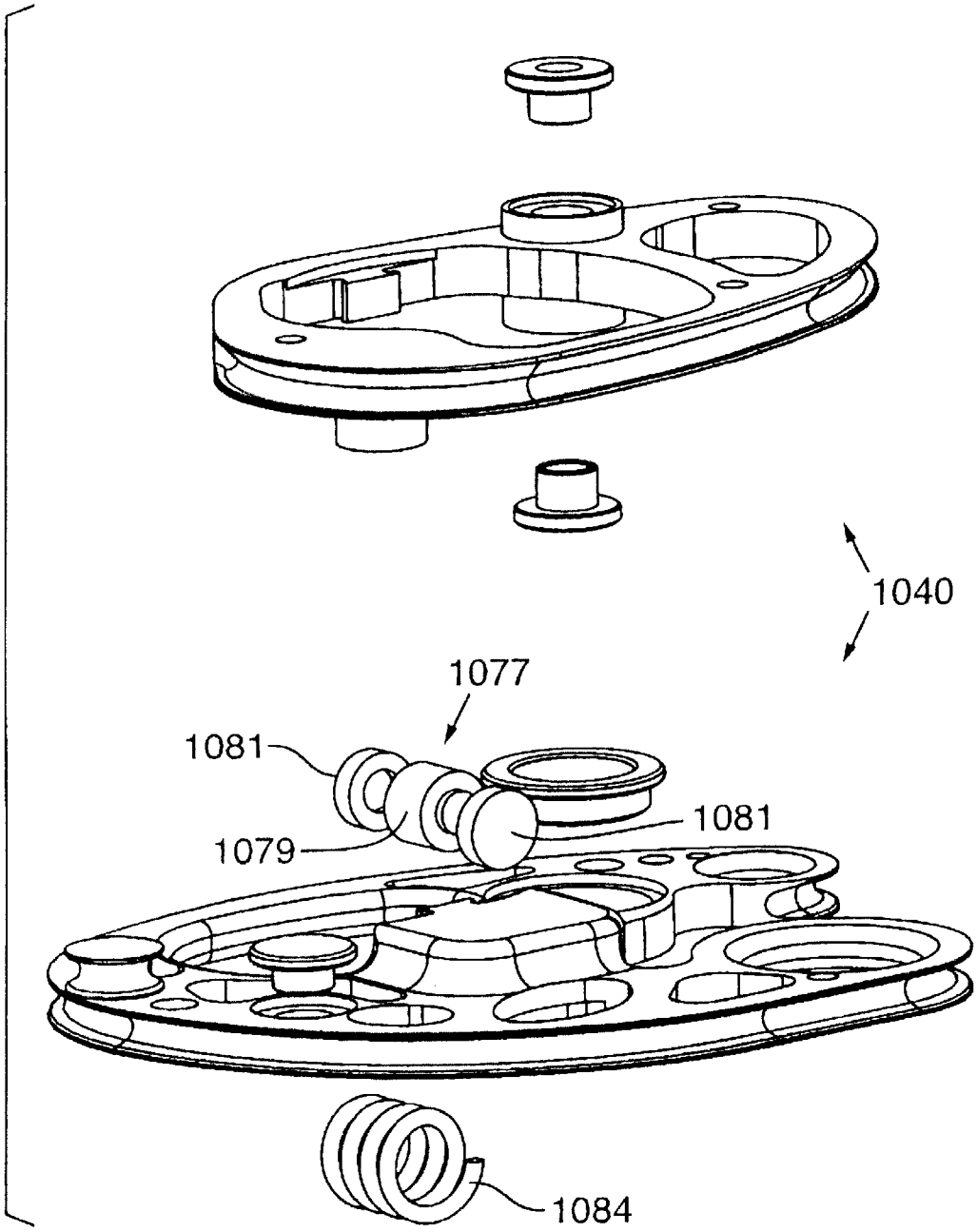
FIG. 30 is a front view of a further additional alternative embodiment of a cam assembly according to the present invention.
Figure 31:
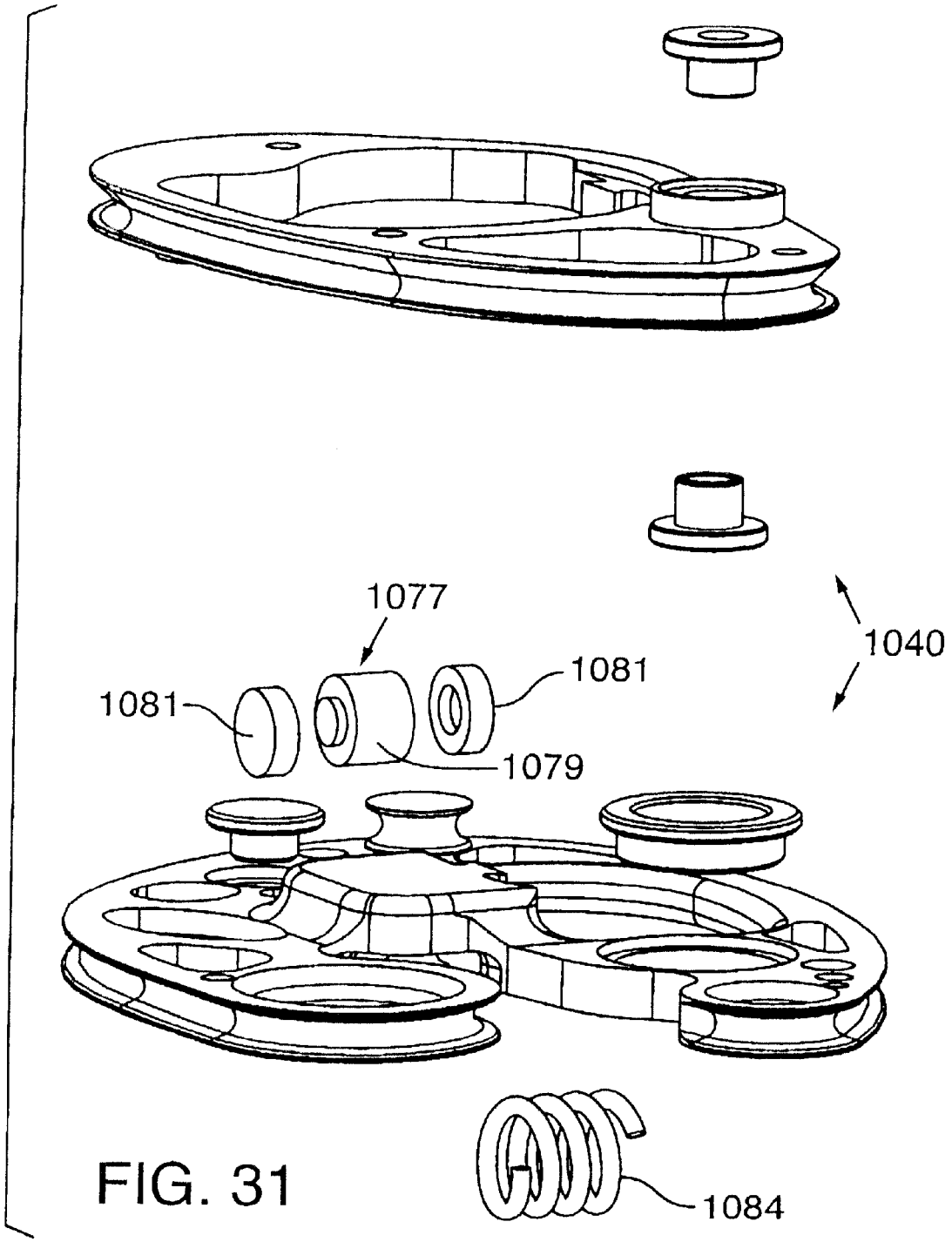
FIG. 31 is an exploded side view of the cam assembly of FIG. 30.
Figure 32:
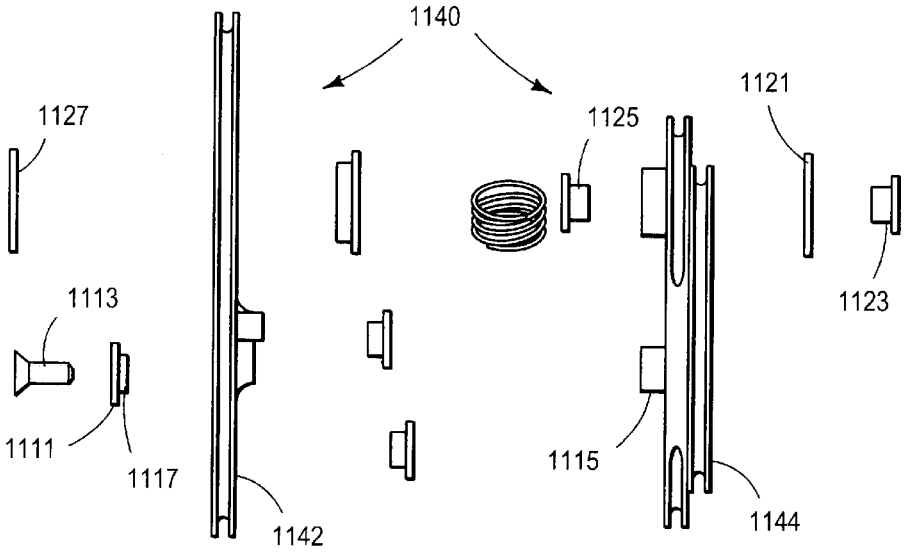
FIG. 32 is an exploded side view of an additional alternative cam assembly.
Figure 33:
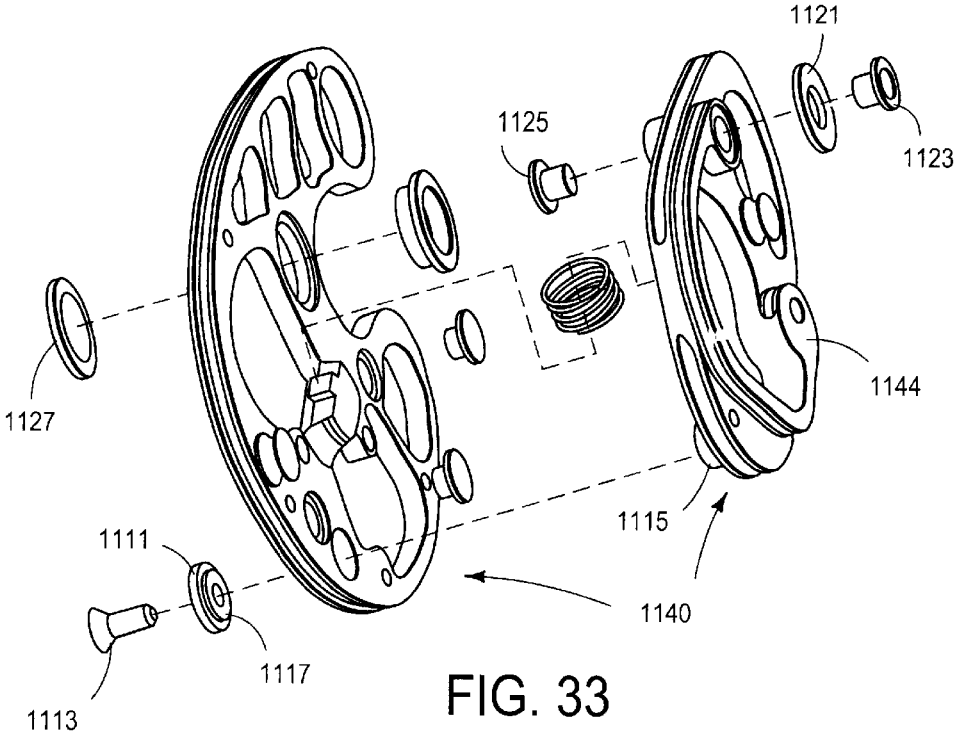
FIG. 33 is an exploded perspective view of the cam assembly of FIG. 32.
Figure 34:
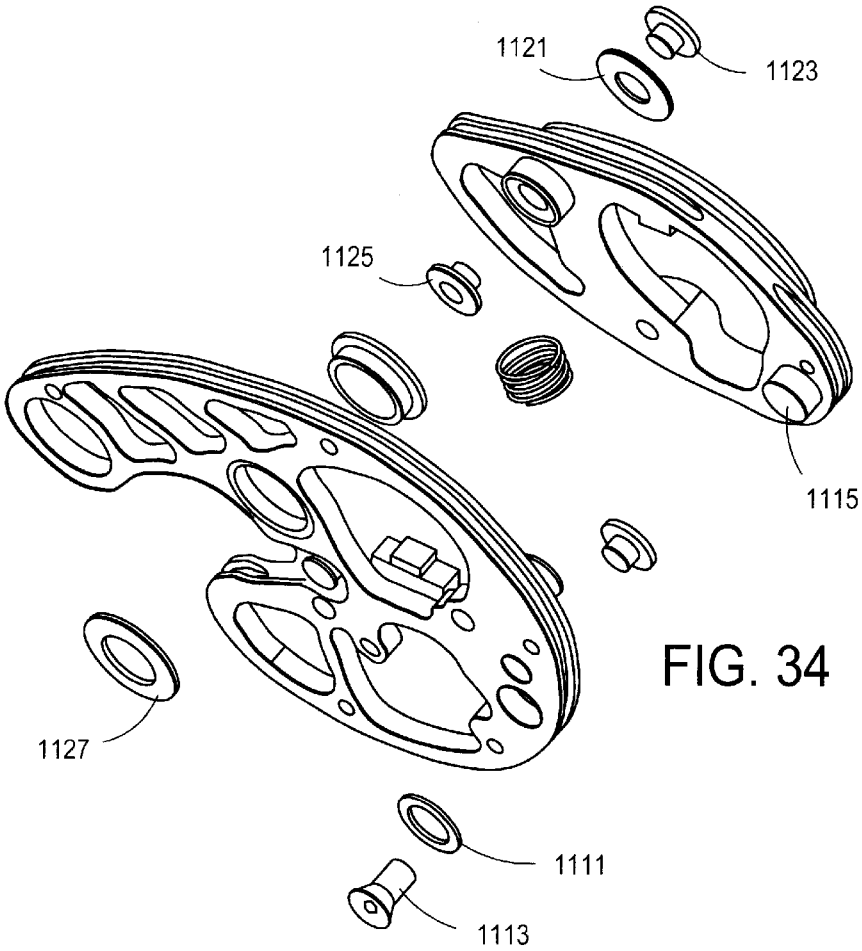
FIG. 34 is an exploded perspective view of the cam assembly of FIG. 32, rotated from the view of FIG. 33.
Figure 35:
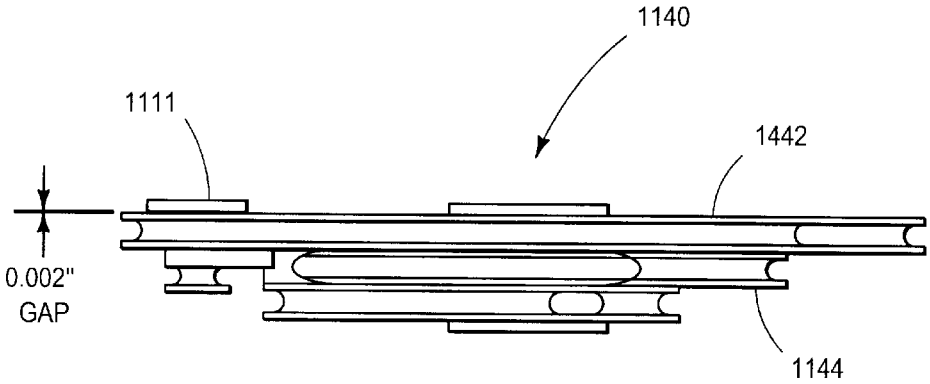
FIG. 35 is a side view of the cam assembly of FIG. 32.

Referring to FIGS. 30–31, in a further alternative preferred embodiment of an archery bow cam 1012, a dead blow assembly 1077, including a dead blow element 1079 and two damping elements 1081, is fitted within a coil spring 1084 to dampen cam vibrations at the end of an archery bow shoot.

Referring to FIGS. 32 through 35, an additional alternative preferred cam assembly 1140, quite similar to the second embodiment, which is shown in FIGS. 17–19, includes a retainer element 1111, to prevent the separation of primary cam 1142 from secondary cam 1144. A retainer bolt 1113 connects with a protruding cam annulus 1115 on secondary cam 1144, to rigidly connect the retainer element 1111 to the secondary cam 1144. The retainer element includes an inner, protruding annulus 1117, which makes contact with the protruding cam annulus 1115, so that when cam assembly is not installed into an archery bow, the retainer element 1111 does not make contact with the outer face of primary cam 1142, but is separated from this face by 125 microns (5 mils). When the cam 1140 is installed in a bow, however, the pressure of the bowstring on primary cam 1142 has a tendency to bend or rotate primary cam 1142 outwardly away from secondary cam 1144. Under these conditions contact is made between retainer element and the outer face of cam 1142. So that the relative motion of cams 1142 and 1144 is not impeded, retainer element is made of a low friction material such as brass or bronze, or even a Teflon coated or low friction composite material. In one preferred embodiment 660 bronze is used.

Another feature of the embodiment of FIGS. 32–35 are thrust washers 1121 and 1127, which work in cooperation with bushings 1123 and 1125. This feature will be discussed with reference to elements 1121 and 1123, with the understanding that elements 1125 and 1127 function in exactly the same manner. Thrust washer 1121 is wide enough so that neither bushing 1123 nor cam 1144 touches the bottom mounting fork (not shown but similar to bottom mounting fork 20 of bow 10). As a result, bushing 1123 is permitted to rotate in an almost frictionless state inside thrust washer 1125. Ideally, thrust washer 1121 is made of a low-friction material, such as a low friction polymer or ceramic.

There is a definite rational for including a mechanical storage device in an archer bow cam assembly. As noted in the background of the invention section, as an arrow is shot a portion of the potential energy stored within the bow limbs is converted into kinetic energy of the rotational members on the bow limbs, which are quickly accelerated to a considerable rotational velocity. After the arrow leaves the bow, this kinetic energy tends to make the bow ring with vibrations. By placing a mechanical energy storage device in a cam assembly (or assemblies) some potential energy is stored in the cam assembly itself. Rather than being converted to kinetic energy in the spinning rotational members (any cam assembly or wheel), this energy is more readily imparted to the bowstring at the end of the shoot, giving a final push to the arrow. As a result, the arrow leaves the bow with a greater velocity and more force, which is highly desirable for archers using compound bows.

The terms and expressions which have been employed in the foregoing specification are used as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A compound archery bow comprising:

(a) a body having first and second flexible ends, opposed to each other;

(b) a first cam assembly rotatably mounted on said body;

(c) a second cam assembly rotatably mounted on said body and spaced apart from said first cam assembly;

(d) a bowstring having at least a portion thereof trained about said rotational assembly and being anchored to said cam assembly;

(e) an anchor cable having a first cable end fixed to said first end of said bow and a second cable end secured to said cam assembly; and (f) said first cam assembly having:

i) a bowstring anchor projection and an anchor cable anchor projection for anchoring said bowstring and said anchor cable, respectively;

(ii) an anchor cable track for taking in said anchor cable as said bow is being drawn;

(iii) a bowstring track for letting out said bowstring cable as said bow is being drawn; and (iv) a mechanical linkage permitting limited relative motion between said bowstring cable track and said anchor cable track; and (g) said second cam assembly, including:

(i) anchor projections for anchoring said additional anchor cable and said bowstring cable;

(ii) an additional anchor cable track for taking in said additional anchor cable as said bow is being drawn;

(iii) a bowstring cable track for letting out said bowstring cable as said bow is being drawn; and (iv) a mechanical linkage permitting limited relative motion between said bowstring cable track and said anchor cable track.

2. The compound bow of claim 1, wherein the range of relative motion permitted by said mechanical linkage is user adjustable.

3. The archery bow of claim 1, wherein said body further includes a handle portion generally situated between said first end and said second end and wherein said handle portion includes a mounting projection and said cam assembly is mounted to said mounting projection.

4. The archery bow of claim 1 further including a retainer element operatively rigidly connected to said anchor cable track and positioned to prevent a lateral separation of said anchor cable track from said bowstring cable tracks.

5. The archery bow of claim 1 further including a retainer element operatively rigidly connected to said bowstring cable track and positioned to prevent a lateral separation of said anchor cable track from said bowstring cable track.

6. An archery bow cam assembly, including tracks for receiving cables, which may be placed into a first state wherein said tracks are in a first arrangement relative to one another or a second state wherein said tracks are in a second arrangement relative to one another and wherein mechanical energy is stored as said cam assembly is placed in said second state from said first state and is released as said cam assembly changes into said first state from said second state.

7. The archery bow cam assembly of claim 6 including a first cam and a second cam, each defining at least one of said tracks, and wherein said second cam has at least a limited freedom of movement relative to said first cam and further including an energy storage mechanism adapted to store or release energy as said second cam is moved relative to said first cam.

8. An archery bow having at least one split limb supporting an axle about which is mounted a cam assembly, and wherein said cam assembly is mounted to said axle by way of a pair of bushings and wherein each said bushing includes an annulus fitting about said axle and a rim extending radially outwardly from one axial end of said annulus and wherein said rim is separated from its respective split limb by a thrust washer sized to define an inner circular opening that just accommodates said rim of said bushing and that is made of low friction material.

9. A compound archery bow comprising:

(a) a body having first and second flexible ends, opposed to each other;

(b) a rotational assembly rotatably mounted on said body;

(c) a cam assembly rotatably mounted on said body and spaced apart from said rotational assembly;

(d) a bowstring having at least a portion thereof trained about said rotational assembly and being anchored to said cam assembly;

(e) an anchor cable having a first cable end fixed to said first end of said bow and a second cable end secured to said cam assembly; and (f) said cam assembly having:

(i) a bowstring anchor projection and an anchor cable anchor projection for anchoring said bowstring and said anchor cable, respectively;

(ii) an anchor cable track for taking in said anchor cable as said bow is being drawn;

(iii) a bowstring track for letting out said bowstring cable as said bow is being drawn; and (iv) a mechanical linkage permitting limited relative motion between said bowstring cable track and said anchor cable track wherein said mechanical linkage includes a mechanical energy storage mechanism adapted to store energy as said bowstring is being drawn and to release energy after said bowstring is released.

10. The compound bow of claim 9, wherein said mechanical energy storage device is a coil spring.

11. The compound bow of claim 9, wherein said energy storage characteristic of said mechanical energy storage device is user adjustable.

12. The compound bow of claim 9, wherein said mechanical energy storage device is an elastomer spring.

13. The compound bow of claim 9, wherein said mechanical energy storage device is a gas cylinder.

14. The compound bow of claim 9, wherein said mechanical energy storage device is a torsional spring.

15. A compound archery bow comprising:

(a) a body having first and second flexible ends, opposed to each other, and a handle portion generally situated between said first and second flexible ends, said handle portion including a mounting projection;

(b) a rotational assembly rotatably mounted on said body;

(c) a cam assembly rotatably mounted on said mounting projection and spaced apart from said rotational assembly;

(d) a bowstring having at least a portion thereof trained about said rotational assembly and being anchored to said cam assembly;

(e) an anchor cable having a first cable end fixed to said first end of said bow and a second cable end secured to said cam assembly; and (f) said cam assembly having:

(i) a bowstring anchor projection and an anchor cable anchor projection for anchoring said bowstring and said anchor cable, respectively;

(ii) an anchor cable track for taking in said anchor cable as said bow is being drawn;

(iii) a bowstring track for letting out said bowstring cable as said bow is being drawn; and (iv) a mechanical linkage permitting limited relative motion between said bowstring cable track and said anchor cable track.

16. A compound archery bow comprising:

(a) a body having first and second flexible ends, opposed to each other;

(b) a rotational assembly rotatably mounted on said body;

(c) a cam assembly rotatably mounted on said body and spaced apart from said rotational assembly;

(d) a bowstring having at least a portion thereof trained about said rotational assembly and being anchored to said cam assembly;

(e) an anchor cable having a first cable end fixed to said first end of said bow and a second cable end secured to said cam assembly; and (f) said cam assembly having:

(i) a bowstring anchor projection and an anchor cable anchor projection for anchoring said bowstring and said anchor cable, respectively;

(ii) an anchor cable track for taking in said anchor cable as said bow is being drawn;

(iii) a bowstring track for letting out said bowstring cable as said bow is being drawn; and (iv) a mechanical linkage permitting limited relative motion, within an adjustable range of relative motion set by a user, between said bowstring cable track and said anchor cable track.

17. A compound archery bow comprising:

(a) a body having first and second flexible ends, opposed to each other;

(b) a rotational assembly rotatably mounted on said body;

(c) a cam assembly rotatably mounted on said body and spaced apart from said rotational assembly;

(d) a bowstring having at least a portion thereof trained about said rotational assembly and being anchored to said cam assembly;

(e) an anchor cable having a first cable end fixed to said first end of said bow and a second cable end secured to said cam assembly; and (f) said cam assembly having:

(i) a bowstring anchor projection and an anchor cable anchor projection for anchoring said bowstring and said anchor cable, respectively;

(ii) an anchor cable track for taking in said anchor cable as said bow is being drawn;

(iii) a bowstring track for letting out said bowstring cable as said bow is being drawn; and (iv) a mechanical linkage permitting limited relative motion between said bowstring cable track and said anchor cable track (v) a retainer element operatively rigidly connected to said anchor cable track and positioned to prevent a lateral separation of said anchor cable track from said bowstring cable track.

18. A compound archery bow comprising:

(a) a body having first and second flexible ends, opposed to each other;

(b) a rotational assembly rotatably mounted on said body;

(c) a cam assembly rotatably mounted on said body and spaced apart from said rotational assembly;

(d) a bowstring having at least a portion thereof trained about said rotational assembly and being anchored to said cam assembly;

(e) an anchor cable having a first cable end fixed to said first end of said bow and a second cable end secured to said cam assembly; and (f) said cam assembly having:

(i) a bowstring anchor projection and an anchor cable anchor projection for anchoring said bowstring and said anchor cable, respectively;

(ii) an anchor cable track for taking in said anchor cable as said bow is being drawn;

(iii) a bowstring track for letting out said bowstring cable as said bow is being drawn; and (iv) a mechanical linkage permitting limited relative motion between said bowstring cable track and said anchor cable track; and (v) a retainer element operatively rigidly connected to said bowstring cable track and positioned to prevent a lateral separation of said anchor cable track from said bowstring cable track.

* * * * *

UNITED STATES PATENT AND TRADEMARK OFFICE

CERTIFICATE OF CORRECTION

PATENT NO. : 6,629,522 B2
DATED : October 7, 2003
INVENTOR(S) : Albert A. Andrews It is certified that error appears in the above-identified patent and that said Letters Patent is hereby corrected as shown below:

Column 7,
Line 60, change “tracks” to -- track --.

Signed and Sealed this

Thirteenth Day of January, 2004

JON W. DUDAS
*Acting Director of the United States Patent and Trademark Office*